United States Patent [19]

Mueller

[11] 4,202,547

[45] May 13, 1980

[54] MOVABLE GOLF GREEN APPARATUS

[76] Inventor: Thomas L. Mueller, 1018 Price Rd., Tempe, Ariz. 85281

[21] Appl. No.: 959,336

[22] Filed: Nov. 9, 1978

Related U.S. Application Data

[63] Continuation-in-part of Ser. No. 815,936, Jul. 15, 1977, abandoned.

[51] Int. Cl.[2] ..... A63B 69/36

[52] U.S. Cl. ..... 273/181 A; 273/182 R; 273/178 B; 273/176 H

[58] Field of Search ..... 273/176 R, 176 A, 176 G, 273/176 H, 176 FA, 176 B, 182 R, 105.6, 181 R, 181 A

[56] References Cited

U.S. PATENT DOCUMENTS

| | | | |
|---|---|---|---|
| 2,586,958 | 2/1952 | Keller | 273/105.6 |
| 2,734,745 | 2/1956 | Tarte | 273/105.6 X |
| 3,231,280 | 1/1966 | Collins | 273/105.6 X |
| 3,488,057 | 1/1970 | Fussell et al. | 273/182 R X |
| 3,633,918 | 1/1972 | Smiley | 273/195 A X |
| 3,658,343 | 4/1972 | Rogers et al. | 273/176 H |
| 3,687,457 | 8/1972 | Mason et al. | 273/176 FA |
| 3,693,979 | 9/1972 | Koett | 273/176 H X |
| 3,862,760 | 1/1975 | Davis | 273/176 H X |
| 3,869,127 | 3/1975 | Kohori | 273/195 B |
| 4,006,907 | 2/1977 | Heffley | 273/176 A X |

*Primary Examiner*—George J. Marlo
*Attorney, Agent, or Firm*—H. Gordon Shields

[57] ABSTRACT

A movable golf green is disclosed which is movable along a predetermined track and the golf green is rotatable to provide a multitude of golf green simulation layouts and changing pin positions to the user of the apparatus.

25 Claims, 27 Drawing Figures

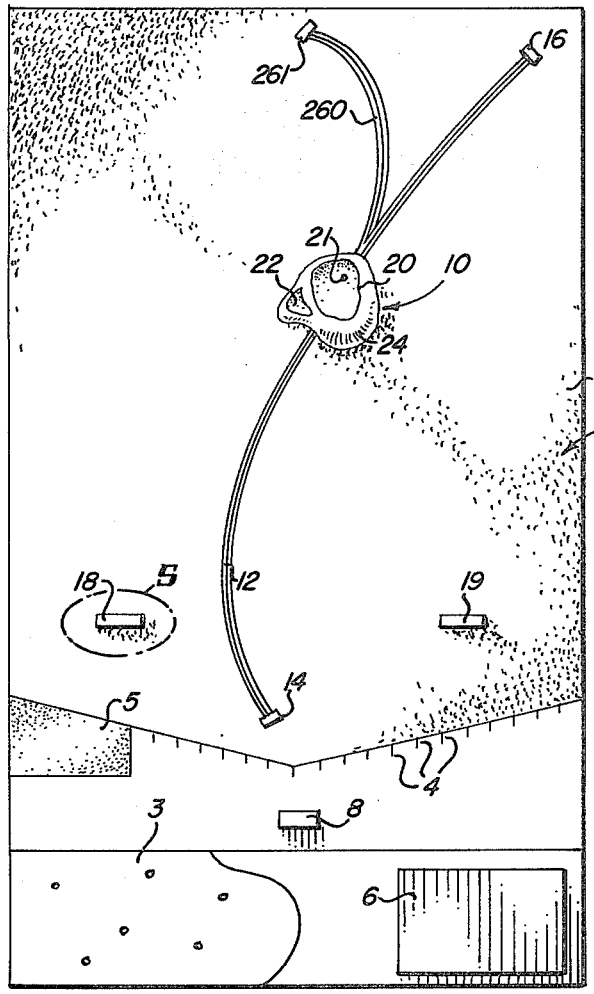
FIG. 1
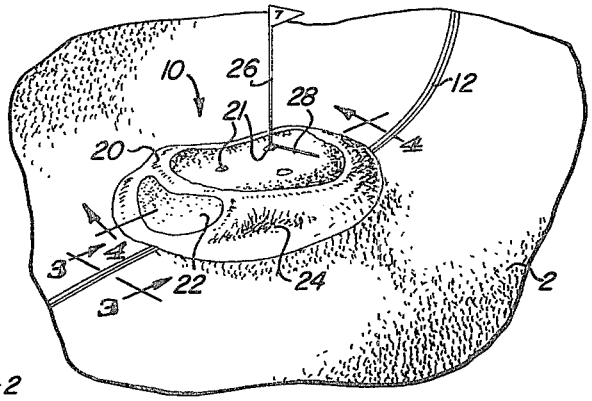
FIG. 2
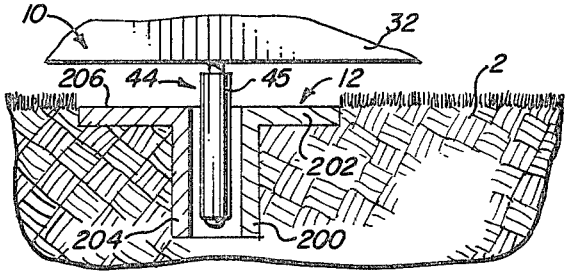
FIG. 3
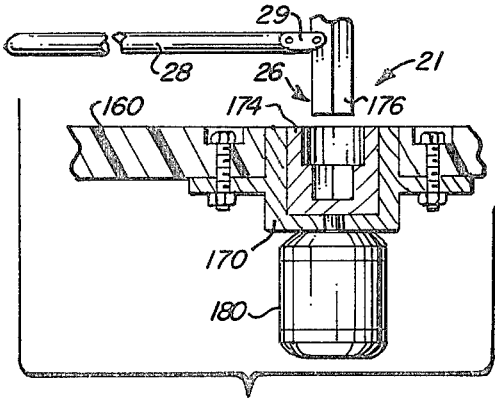
FIG. 7
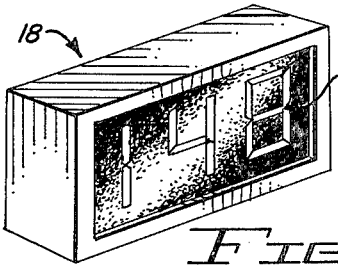
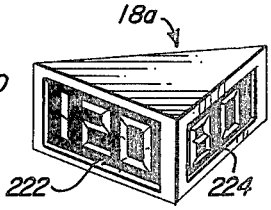
FIG. 5 FIG. 5A
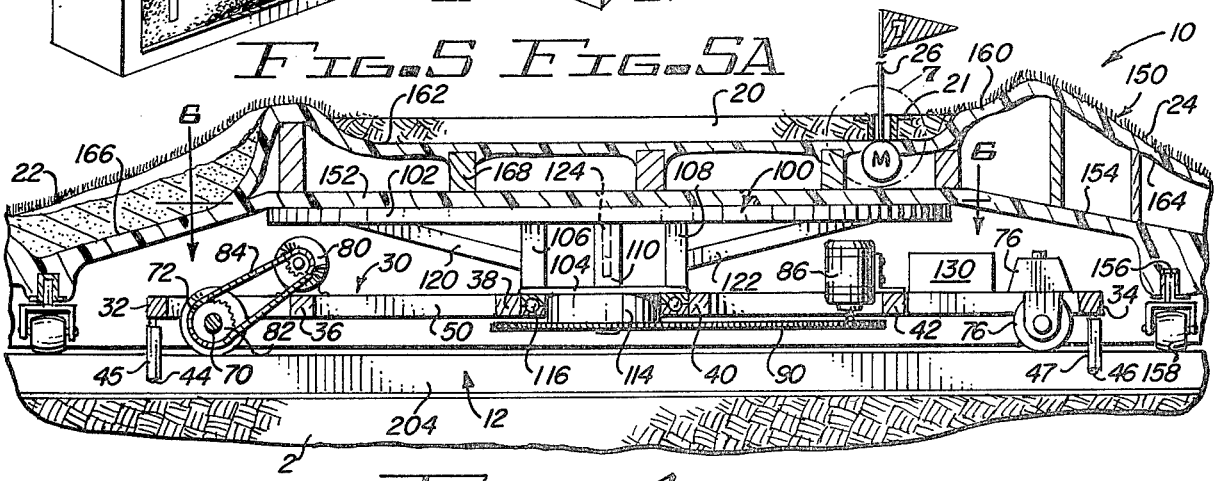
FIG. 4

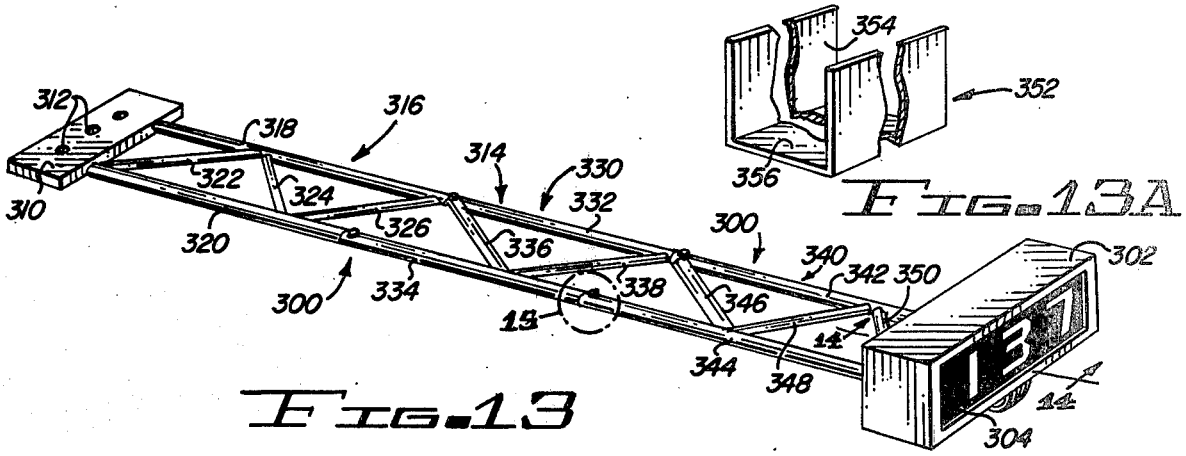
FIG. 13A
FIG. 13
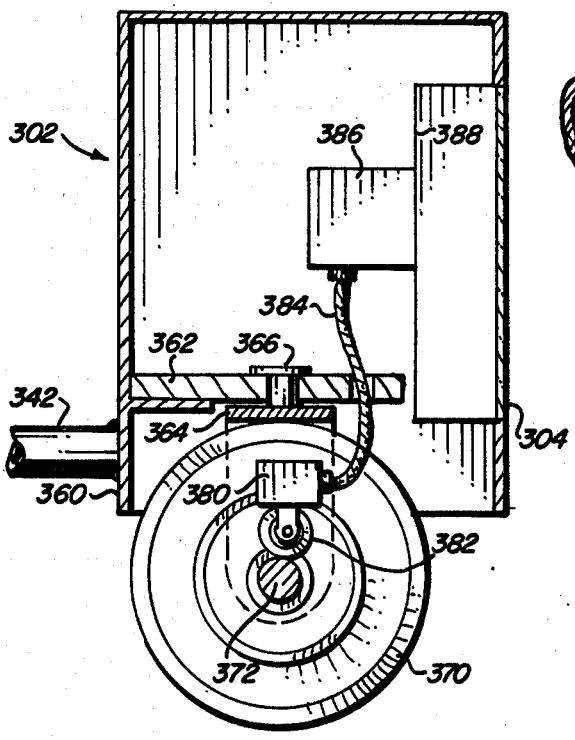
FIG. 14
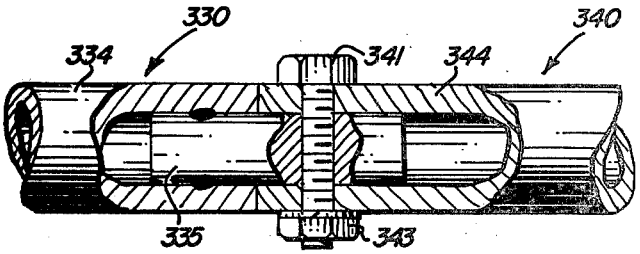
FIG. 15
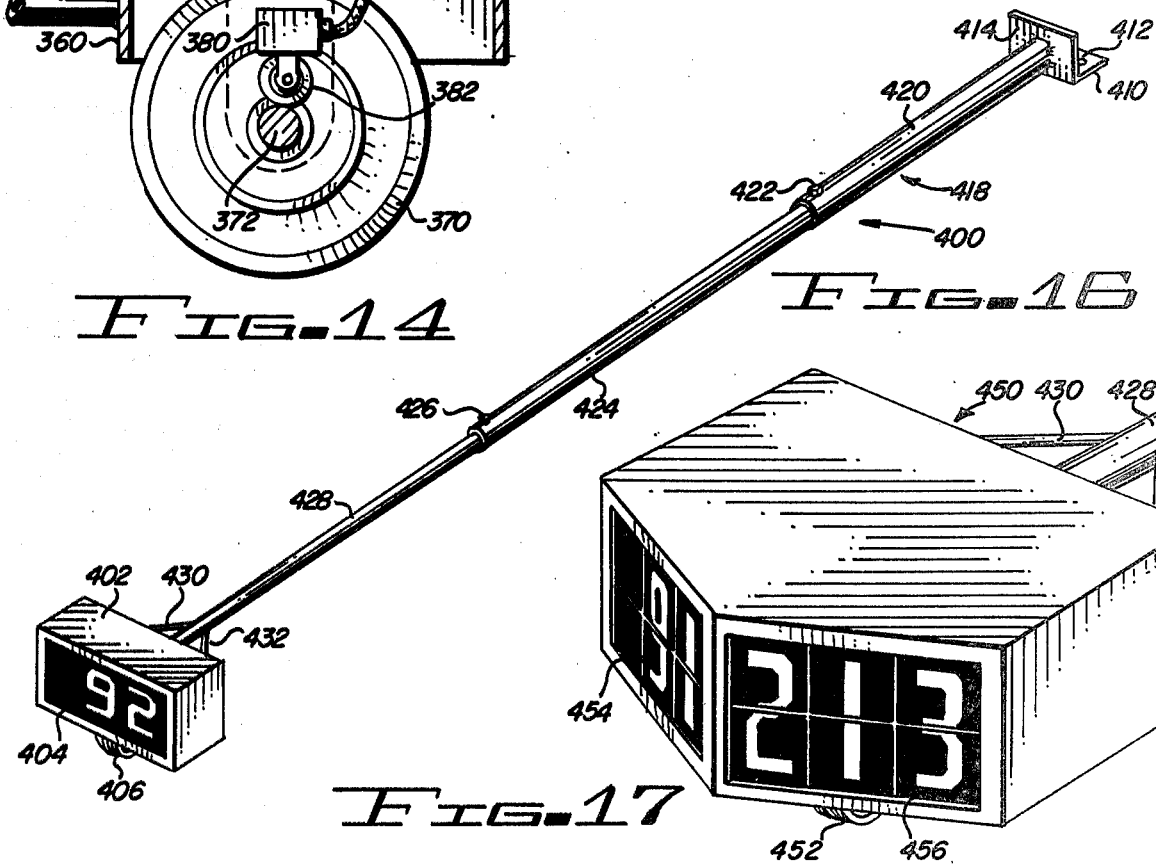
FIG. 16
FIG. 17

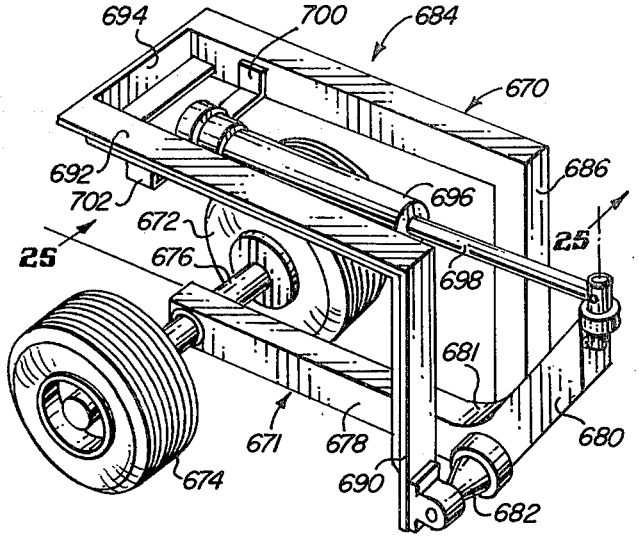
FIG. 24
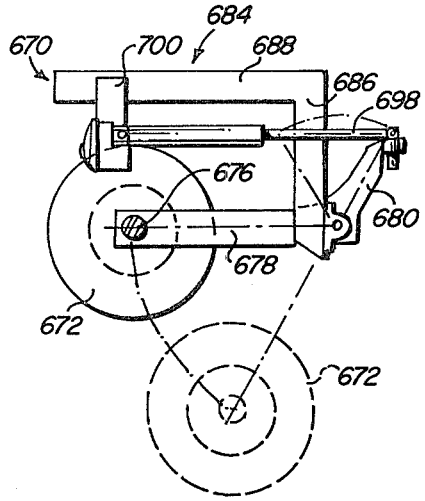
FIG. 25
FIG. 22
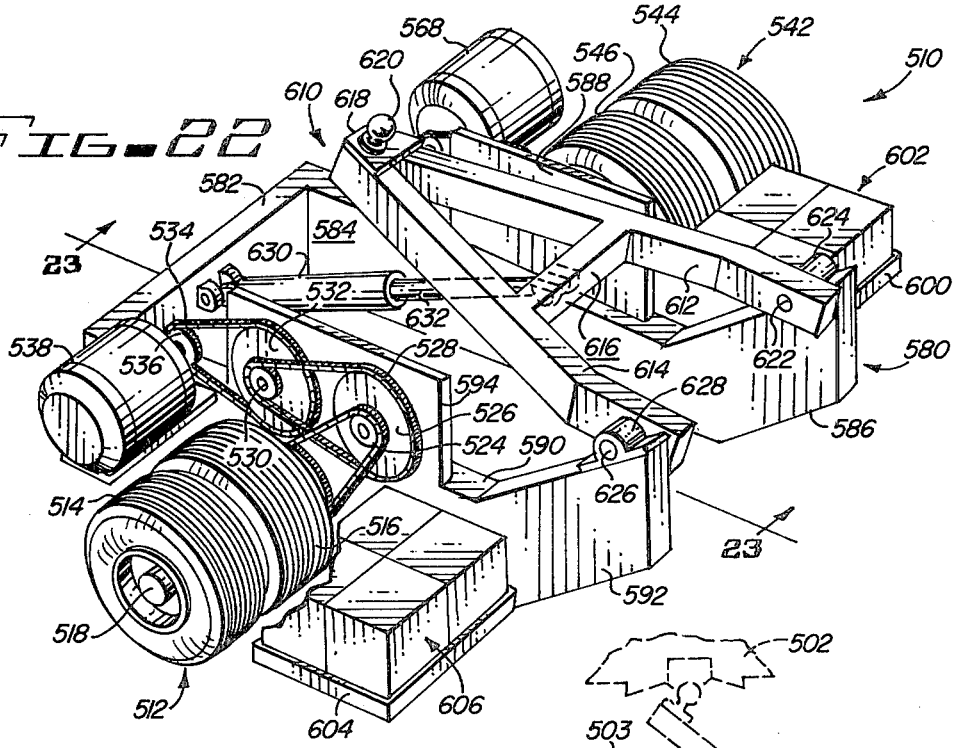
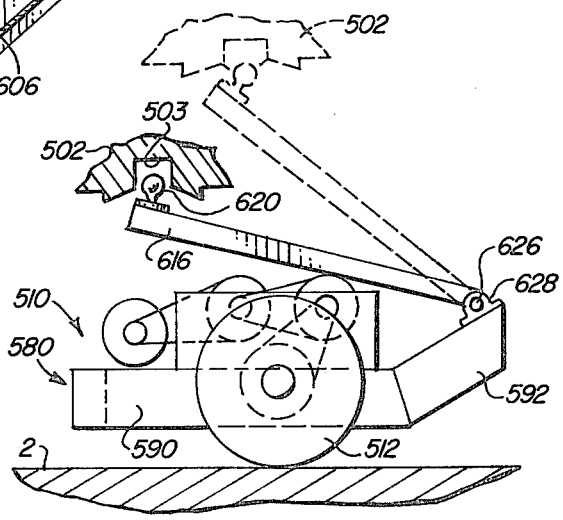
FIG. 23

MOVABLE GOLF GREEN APPARATUS

CROSS-REFERENCE TO RELATED APPLICATION

This application is a continuation-in-part of application Ser. No. 815,936, filed July 15, 1977, now abandoned.

BACKGROUND OF THE INVENTION

1. Field of the Invention

This invention relates to golfing apparatus, and, more particularly, to a golf green apparatus movable over a predetermined course and rotatable about a predetermined axis.

2. Description of the Prior Art

To enable a golfer to maximize practice efforts in a minimum amount of time and to maximize the use of available land by minimizing the areas devoted to various types of practices, variable golf tees and variable golf greens have been developed. For example, U.S. Pat. No. 2,937,875 discloses a movable platform used as a golf tee from which various golf shots may be practiced. Shots involving uphill, downhill, and sidehill lies may be practiced by changing the orientation of the movable platform.

U.S. Pat. No. 3,633,918 discloses similar apparatus for simulating uneven lies from which a golfer may practice various golf shots.

A more elaborate type of golf practice device is disclosed in U.S. Pat. No. 3,693,979. The apparatus in the '979 patent comprises a wedge shaped member disposed on a rotatable ease. An alternate embodiment, a pair of wedge shaped members are disposed on a common axis and movable relative to each other to provide a variety of angular orientations for the top surface.

Another variable golf practice tee apparatus is disclosed in U.S. Pat. No. 3,869,127. This apparatus is designed primarily for use in a location other than at a golf course. Obviously, however, such apparatus may also be used at a golf course. The apparatus is manually adjustable by means of a handle.

U.S. Pat. No. 3,658,343 discloses a contourable putting green for use in indoor golf games. A plurality of motor driven reversible hydraulic jacks moves portions of the putting green to provide a varying contour of the green.

The patents discussed above may be divided into two categories, the first category of which comprises a movable or varied contoured putting green. For putting practice the contourable putting green provides a plurality of different contours to the putting green for enabling a golfer to practice putting on virtually an infinitely contourable green. Similarly, the variable golf tees provide a golfer with a plurality of different lies from which to practice golf shots. Accordingly each apparatus has its place in providing a golfer with a maximum amount of practice in a minimum amount of time and space, depending on the particular situation. However, there is no apparatus of which the present invention is aware which provides a golfer with the ability or capability of practicing driving to a green over variable distances and with a variable contour to the green. The apparatus of the present invention overcomes the deficiency of the prior art by providing a golfer with a practice range in which the green moves toward and away from the golfer and provides the golfer in a variety of distances not limited to straight line or longitudinal movement with a variable approach to the green.

SUMMARY OF THE INVENTION

The apparatus disclosed and claimed herein comprises a movable golf green which moves along a track or guide and which rotates on an axis. The movement of the golf green provides a variable distance to a golfer driving from a fixed location and since the golf green apparatus rotates, a variable golf green with variable trap locations or placements may be presented to the user in addition to the variable distance. Moreover, variable pin placements may also be included. To enable the user (golfer) to more accurately correlate the location of the movable golf green apparatus with distance, apparatus is included for presenting a visual distance display.

Among the objects of the present invention are the following:

To provide new and useful golf apparatus;

To provide new and useful golf green apparatus;

To provide new and useful movable golf green apparatus;

To provide new and useful rotatable golf green apparatus;

To provide new and useful golf green apparatus rotatable on an axis;

To provide new and useful rotatable golf green apparatus movable along a predetermined course;

To provide new and useful golf practice apparatus having a plurality of orientations for simulating various golf shots from fixed locations;

To provide new and useful golf apparatus having a plurality of pin locations;

To provide new and useful rotatable golf green apparatus having a rotating sweep for sweeping balls off the green;

To provide new and useful golf green apparatus movable over a variety of distances;

To provide new and useful golf green apparatus rotatable to provide a plurality of orientations relative to a fixed location;

To provide new and useful movable golf green apparatus including visual distance information; and To provide new and useful golf practice apparatus.

BRIEF DESCRIPTION OF THE DRAWING

FIG. 1 is a plan view of a practice golf course including apparatus of the present invention.

FIG. 2 is a perspective view of a portion of the apparatus of FIG. 1.

FIG. 3 is an enlarged view in partial section of a portion of the apparatus of FIG. 2 taken generally along line 3—3 of FIG. 2.

FIG. 4 is an enlarged view in partial section of a portion of the apparatus of FIG. 2 taken generally along line 4—4 of FIG. 2.

FIG. 5 is a perspective view of visual display apparatus usable with the apparatus of the present invention taken generally from circle 5 of FIG. 1.

FIG. 5A is an alternate embodiment of the apparatus of FIG. 5.

FIG. 7 is an enlarged view in partial section of the apparatus of FIG. 4 taken generally from circle 7 of FIG. 4.

FIG. 13 is a perspective view of an outrigger type visual display apparatus for use with the apparatus of the present invention.

FIG. 13A is a perspective view of a bracket for use with the apparatus of FIG. 13.

FIG. 14 is an enlarged view in partial section of the apparatus of FIG. 13 taken generally along line 14—14 of FIG. 13.

FIG. 15 is an enlarged view in partial section of the portion of the apparatus of FIG. 12, taken generally from the circle 15 of FIG. 13.

FIG. 16 is a perspective view of an alternate embodiment of the apparatus of FIG. 13.

FIG. 17 is an alternate display apparatus usable with the apparatus of FIGS. 13 and 16.

FIG. 22 is an enlarged perspective of a portion of the apparatus of FIGS. 18–21.

FIG. 23 is a view illustrating the operation of the apparatus of FIG. 22, taken generally along 23—23 of FIG. 22.

FIG. 24 is a perspective view of a portion of the apparatus of FIG. 18.

FIG. 25 is a side view of the apparatus of FIG. 24 taken generally along line 25—25 of FIG. 24.

DESCRIPTION OF THE PREFERRED EMBODIMENT

Figure 6:
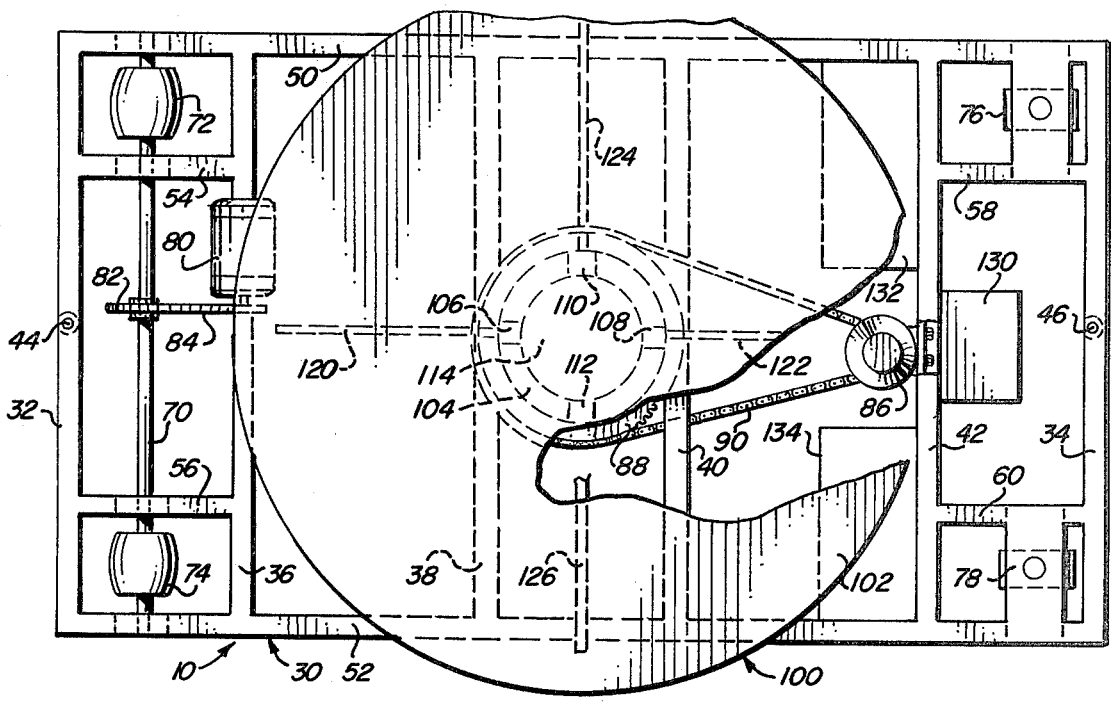
FIG. 6 is a plan view of a portion of the apparatus of FIG. 4 taken generally along line 6—6 of FIG. 4.

FIG. 1 is a plan view of a practice golf course including apparatus of the present invention. The practice golf course is generally denoted by reference numeral 1. The course 1 includes a fairway 2 which comprises the largest portion of the practice course 1. A putting green 3 is also included, but remotely from the fairway 2. Between the putting green 3 and the fairway are a plurality of tee stations or tee boxes 4, which comprises driving mats for golfers, and which extend generally from one side of the practice course to the other. A plurality of individual users (golfers) may use the practice course at the same time by having a plurality of tee stations. At one end of the plurality of tee boxes or stations is a sand bunker 5 from which a plurality of golfers may practice shots to the green. Sand bunker shots are probably the most difficult in golfing, and the apparatus of the present invention allows golfers to practice shots out of bunkers towards a green which is, or may be, at various distances from the bunker. This type of practice is virtually impossible to obtain with other than the apparatus of the present invention. Adjacent the practice putting green 3 is a main building 6 which houses the offices, electrical controls for the apparatus of the present invention, and equipment to be rented, and the like. In addition to electrical controls, which will be explained in detail below, there is a secondary or remote control station 8 located outside the main control building and adjacent the tee stations or tee boxes 8.

On the fairway 2 is a movable green 10 which moves in response to appropriate control signals from either the control box 8 or a control panel within the main building 6. The green 10 moves on a track 12, which is illustrated as being of a curved configuration and terminated by a front track end 14 located adjacent the control box 8 and generally in the center of the course, and a back or out track end 16 located remotely from the tee stations and at the "far" or back end of the practice course 1. A spur track 260 branches away from the track 12 and terminates in a track end 261. The spur 260 curves away from the track 12 and provides an alternate route for the movable green 10. a pair of fixed distance markers 18 and 19 is shown adjacent the track 12 and forwardly of the tee stations 4 and the sand bunker 5. The purpose of the distance markers 18 and 19 is to advise individuals using the apparatus of the distance away from the tee stations and bunker that the movable green 10 is located.

The movable green 10 is of an irregular configuration as shown, although it may be a regular configuration, which includes a putting green 20 and a sandtrap 22 and an apron portion 24 extending outwardly from the putting green 20. The overall configuration of the apparatus may be as desired, and it may include a plurality of sand traps 22, or other artificial hazards, and a plurality of cups 21. The green 10 is movable on the track 12. The green is also rotatable on a central frame, as disclosed in the drawing and discussed below. Thus the apparatus may be rotated for different types of practice shots to differently oriented greens, and it may be moved inwardly or outwardly to allow golfers to practice various types of shots from a variety of distances. It will be noted that the apparatus 10 is referred to as a "movable golf green." However, technically speaking, it includes the feature normally associated with a "green" as its periphery, namely an apron portion and a sand trap. For convenience herein, the apparatus 10 will continue to be referred to as "movable golf green apparatus."

FIG. 2 is a perspective view of a portion of the apparatus of FIG. 1, comprising an enlarged perspective view of the movable green 10 disposed on a portion of the track 12 on the fairway 2. The movable green 10 is shown enlarged somewhat from that in FIG. 1 to show details of the exterior configuration of the movable greens. The movable green 10 is shown with the putting green 20 disposed on the top. The configuration of the putting green 20 may be generally flat, but of an irregular outer peripheral configuration, or it may comprise any desired configuration. It will be noted that the putting green 20 is raised above the surrounding fairway 2. This is obviously necessary, due to the structural members of the apparatus 10, which will be discussed below in conjunction with FIGS. 4 and 6.

Extending outwardly and downwardly from the putting green 20 is an apron 24. The apron 24 extends from the putting green downwardly and outwardly at a slope to the fairway 2. The configuration of the apron may, like the putting green, be of any outer peripheral shape or configuration as desired. The apron 24 may include one or more sand traps 22, as desired. The slope of the apron from the fairway or ground 2 upwardly to the putting green 20 may also be varied, as desired. The outer periphery of the apron is disposed adjacent the fairway 2 such that a golf ball driven from a tee station 4 (see FIG. 1) will either land on the green 20 or bounce onto the apron, and then, hopefully, onto the putting green 20 or into a sand trap 22 rather than rolling beneath the apparatus 10. A pin 26 is shown extending upwardly from a cup 21 on the putting green 20. If desired, more than one cup 21 may be disposed on the green 20. The cups 21 are preferably rotatable. The pin 26 includes a pin sweep 28 pivotally secured to the pin and extending radially outwardly from the cup in which the pin is located. The cup may rotate and with it the pin and sweep also rotate to sweep balls on the green 20 away from immediately around the cup. The object of each drive, practice or otherwise, is to put a golf ball in the cup, or as close to the cup as possible. Accordingly, the green area adjacent a cup should be free of balls as much as possible. The overall effect of the movable green 10 is one of realism as much as practical to provide an effective training device or golf simulator for practicing.

In FIG. 2, the movable green 10 is shown straddling a track 12. The track 12 is used to guide the movable green over a predetermined course. That is, the track 12 is fixed with respect to the practice course 1, shown in FIG. 1, and the movable green 10 moves on or relative to the track and accordingly relative to the course as it is guided on the track. The actual configuration of the track is immaterial. If desired, a complete loop, however regular or irregular, may be used.

FIG. 3 is a view in partial section taken generally along line 3—3 of FIG. 2. It comprises an enlarged view in partial section of the movable green apparatus 10 and the fairway 2 and the track 12 illustrating the guidance of the movable green 10 by the track. The movable green 10 includes a front transverse frame member 32 to which is appropriately secured a front guide pin 44. The guide pin 44 extends downwardly substantially perpendicular to the vehicle frame, and accordingly perpendicular to the fairway 2. The guide pin 44 includes an exterior roller 45 which is supported by the pin and freely rotatable thereon.

The track 12 extends downwardly into the ground of the fairway 2 and comprises a pair of parallel and spaced apart walls 200 and 204. The walls 200 and 204 are substantially perpendicular to the plane of the fairway 2 and they extend downwardly into the ground from the top surface of the fairway. Each wall has an outwardly extending wall flange connected directly to the upper portion of the wall. The wall 200 includes a flange 202, and the wall 204 includes a flange 206. The flanges 202 and 206 extend in opposite directions from each other, but they are substantially aligned with respect to each other. They provide a grass-free area about the track 12. The flanges 202 and 206 are shown as an integral part of the track walls 200 and 204. However, this is for convenience only. The primary purpose of the flanges is to provide a grass-free area adjacent the track to help keep the track free of grass, debris, etc. If the flanges are solid, like the walls, a golf ball hitting a flange will bounce substantially differently from a ball hitting the fairway 2 or the apparatus 10. Accordingly, for realism and yet to provide the practical advantages of a grass and weed free area adjacent the track, a strip of artificial grass or turf may be used in place of the flanges 202 and 206.

It will be noted that the bottom of the track 12, beneath the walls 200 and 204, opens directly into the ground. The bottom of the track may be lined, as with gravel, or the like, but preferably is not solid so as to prevent the draining of rain or other water which flows or falls into it. The track accordingly is kept open and free from standing water from rain, the watering of the golf course fairway, and the like.

The movable green 10 is disposed relatively close, vertically, to the fairway 2 as is possible, or as is practical. Moreover, the lower the apparatus, the more realistic it will appear. There are obvious advantages in having the vehicle disposed close to the ground, such as to prevent golf balls from rolling underneath the green, appearance, and the like.

The guide pin 44 into the track, between the vertical walls 202 and 204. The width or spacing between the walls of the track is sufficient to adequately accommodate the guide pin without binding, and yet is not so large that the pin will bounce between the walls as the golf green apparatus is moving. Moreover, the spacing between the walls 202 and 204 is such that a golf ball will not fall into the track between the walls 200 and 204.

FIG. 4 is a view in partial section of a portion of the apparatus of FIG. 2 taken generally along line 4—4 of FIG. 2. It comprises a view in partial section through the movable golf green 10.

The movable green 10 comprises a lower frame 30, a rotating frame 100 disposed on and secured to the lower frame, and a top frame 150. The top frame 150 is appropriately secured to, and movable with, the rotating frame 100.

The lower frame 30 comprises a plurality of structural frame members, including a front transverse frame member 32 and a rear transverse frame member 34, with four intermediate transverse frame members 36, 38, 40, and 42 spaced apart between the front and rear transverse frame members 32 and 34. The transverse frame members are secured to a pair of longitudinally extending side frame members, of which a right side member 50 is shown in FIG. 4. The lower frame 30 is movable on four wheels, of which a front driving wheel 73 and a rear caster wheel 76 are shown in FIG. 2. The driving wheels are located towards the front of the lower frame and are connected by a transversely extending axle 70. A motor 80 is shown disposed on the lower frame 30 and appropriately secured to the frame at the front transverse frame member 32. A sprocket 82 is appropriately secured to the axle 70 and rotates therewith in response to the motor 80. A chain 84 couples the motor to the axle 70 through the sprocket 82 and through an appropriate sprocket secured to the drive shaft of the reversible motor 80.

It will be noted that for illustrative purposes, the transverse frame member 32 has been designated as the "front," while the frame member 34 has been designated as the "rear" member. The apparatus is thus arbitrarily defined as having a front and a rear. However, the designations are for illustrative purposes only. It will be understood that the apparatus moves "forward" and "backward" along the track.

The movable green 10 is guided in track 12 by means of a pair of guide pins 44 and 46. The guide pin 44, with its roller 45, is secured to the front transverse frame member 32 and it extends downwardly therefrom into the track 12. The rear guide pin 46 also includes an appropriate roller 47 which also extends downwardly from the lower frame into the track 12. The rear guide pin 46 is shown extending downwardly, and is secured to, the rear transverse frame member 34. Preferably, the guide pins 44 and 46 are disposed intermediate the side frame members and along the longitudinal axis of the lower frame 30.

The guide pin 46 extends downwardly from the rear transverse frame member 34, which is located at the rear of the lower frame 30, but forwardly of the outer portions of the movable green 10, just as the guide pin 44 is disposed at the forward or front portion of the lower frame 30, but inwardly from the outer peripheral portion of the movable green 10.

The rotating frame 100 includes a platform 102 secured to a plate 104, but spaced therefrom, by a plurality of vertically extending braces 106, 108, and 110, shown in FIG. 4. Another vertical brace, brace 112, is shown in phantom in FIG. 6. The vertically extending braces are secured both to the platform 102 and to the plate 104. The plate 104, disposed beneath and spaced apart from the platform 102, is in turn secured to a rotating drum 114. The drum 114 is journaled for rotation with respect to the lower frame 30 by appropriate bearings 116. The platform 102 and the plate 104 are both preferably circular and flat in configuration, and the platform 102 is substantially larger in diameter than is the plate 104. The bearings 116, the drum 114, the plate 104, and the platform 102 are all disposed between the intermediate transverse frame members 38 and 40.

In addition to the vertical braces 106, 108, and 110, shown in FIG. 4, a plurality of diagonally extending braces 120, 122, and 124 are also shown in FIG. 4 as providing additional support for the platform 102. Another diagonal brace 126 is shown in phantom in FIG. 6. There are thus four vertically extending and four diagonally extending braces which provide structural support between the plate 104 and the platform 102. The diagonal braces may be gusset plates, as desired.

A motor 86 is approp iately secured to the transverse frame member 42 rearwardly of the drum 114. Gears are secured to both or either the drum 114 and the motor 86, and a belt or chain 90 couples the motor to the drum through the gears and pulleys or sprockets. The motor 86, in response to appropriate control signals, causes the drum 114, and accordingly the platform 102, to rotate relative to the lower frame 30.

The controls for the movable green apparatus 10 are located in a control box 130 which is shown secured to the lower frame 30 between the rear transverse frame member 34 and the intermediate transverse frame member 42. Appropriate electrical connectors extend to both the motors 80 and 86.

A top frame 150 is shown in FIG. 4 disposed on, and supported by, the rotating frame 100. The top frame 150 is preferably of lighter weight material, such as fiberglass, aluminum tubing, foam, and the like, as opposed to the stronger, preferably steel, structural frame members associated with the lower frame 30 and the rotating frame 100.

The top frame 150 includes a base 152 which is disposed on and secured to the platform 102. Extending outwardly and downwardly from the base 152 is an outer peripheral base 154. The outer peripheral base 154 extends outwardly with respect to the lower frame 30. Due to the size of the top frame 150, a plurality of wheel wells 156 may be appropriately disposed adjacent the outer periphery of the outer peripheral base 154. The wheel wells 156 receive caster wheels 158 which are secured therein and provide support for the outer peripheral portions of the movable green 10. The wheels 158 are preferably located at the same radial distance from the center of rotation of the rotation frame 100. If the size and shape of the green does not warrant the wheels 158, they may be omitted.

Secured to, but extending upwardly from the base 152 is a green form 160. The green form 160 is secured to the base 152 by a plurality of structural members 168. In FIG. 4 the structural members 168 are shown as being vertically extending. The green form 160 includes three primary portions, namely a putting green center portion 162, an apron form 164, and a trap form 166. The putting green center form 162 is a concave portion of the green form 160 which receives the appropriate material to provide on the top thereof a generally level green 20. The apron form 164 is outwardly extending from the putting green center form 162 and it receives, secured thereon, the apron 24 which comprises the outer peripheral portion of the movable green 10. The trap form 166 comprises a concave portion of the apron form 164. It receives the trap 22.

The pin 26 is shown extending upwardly from a cup 21 on the green 20. If desired, the cup 21 may extend downwardly beneath the green form 160 and may include a signal device to advise that a hole-in-one has been achieved by a user of the apparatus. A plurality of cups is shown to provide for different and varied pin placements.

As stated above the cups preferably rotate so that the pin sweep attached to the pin may clear away golf balls. Each cup preferably is secured directly to its own motor, as schematically illustrated in FIG. 7. The motors may be connected together for simplicity of wiring so that while only one pin is used, it may be moved from cup to cup and will sweep in conjunction with the rotation of any cup in which it may be disposed.

The movable green 10 comprises three separate portions, including a lower frame 30, which is guided along a fixed track in a fairway 2 by a pair of downwardly extending pins secured to the lower frame and extending into the track. A reversible motor 80 is coupled to the driving wheels of the lower frame to allow the movable green apparatus to move in two directions along the track. The driving wheels, coupled to the driving motor, are fixed wheels, while the wheels remote from the driving wheels, and also secured to the lower frame, are caster wheels which allow the movable golf green apparatus 10 to be appropriately guided over a winding, or serpentine, non-linear track.

The rotating frame 100 is in turn secured to, and journaled for rotation on, the lower frame 30. It provides support for a top frame 150 which covers both the rotating frame and the lower frame. The top frame includes two primary portions, a base which is disposed on, and secured to, the platform 102, and a green form 160 which is in turn secured to the base 152. The green form 160 includes two primary portions, a putting green center portion and an outwardly and downwardly extending apron portion. A trap form is shown included in one portion of the apron form for the green apparatus 10. Obviously, there may be more than one trap on the apparatus or the trap may be omitted, as desired. However, for purposes herein, a single trap is shown. The trap may include a drain hole or container for golf balls, if desired.

In addition to moving longitudinally with respect to the fairway (see FIG. 1) on a track, the movable green 10 also rotates to provide a variety of approaches from the tee stations (see FIG. 1).

The movable green 10 accordingly provides a realistic target for practicing various types of golf shots. By moving the green 10 away from the tee boxes or stations 4 and the sand bunker 5, as shown in FIG. 1, driving shots can be practiced, and by moving the green closer to the tee stations and the bunker, various pitch and chip shots can be practiced. Moreover, by rotating the green, a variety of approach shots can also be practiced, such as over a trap, and the like. The green provides a realistic setting in that the putting green, in the center of the apparatus, is surrounded by a gently sloping apron and by one or more traps, if desired. It will be noted, of course, that the actual configuration of the top frame 150 may be as desired, either regular or irregular. Moreover, the slope of the apron may be varied. In other words, a wide variety of conditions may be built into the movable green apparatus to simulate a wide variety of actual golf situations.

The movable green apparatus may be as large or as small as desired, and it may be relatively shallow or relatively high, again as desired. The overall height of the apparatus is limited to a minimum necessary to accommodate the various structural elements and the motors, controls, and batteries required to power the motors. Casterable outrigger wheels are provided to protect the outer peripheral edges of the apron form 164 by preventing the apron form from digging into or dragging on the fairway as the apparatus moves and rotates. The wheels thus also protect the fairway. Skids could be used in place of wheels, but wheels appear to be preferable.

FIGS. 5 and 5A are perspective views of two embodiments of visual display apparatus usable with the apparatus of the present invention, and illustratively taken from circle 5 of FIG. 1. The visual distance or yardage display apparatus of FIG. 5 comprises a generally rectangular box with appropriate provisions for electronically providing an illuminated distance display. Visual display box 220 includes a front face 222 which includes provisions for three numerals. In FIG. 5, the numerals displayed are "148, " which indicates that the movable green 10 is approximately 148 yards from the tee stations. Obviously, the distance would not be accurate for all tee boxes, or rather would be accurate only from a specific location since the tee boxes or stations are each at a slightly different distance from the mo able green at any particular time. For maximum accuracy, the tee boxes may be oriented on an arc comprising a radius of curvature from a predetermined point on the track.

The display of the distance on the face 222 may be any desired arrangement, such as a plurality of lamps which are appropriately connected together to provide numbers, a rotating digital display, or the like.

With respect to the visual display apparatus 18 illustrated in FIG. 5, only a single display face is shown, and it accordingly must be oriented appropriately so as to provide a visual display for a maximum number of users of the golf course. The display is spaced apart from the various tee stations so as not to interfere with the driving from the tee stations.

In FIG. 1, two distance markers are shown, one located on one side of the practice course and another located on the opposite side of the practice course. The two separate and spaced apart markers thus allow visual sightings from virtually all of the tee boxes.

An alternative to a single visual display face, such as shown in FIG. 5, is shown in FIG. 5A by a visual display apparatus 18*a*. The visual distance display apparatus 18*a* is of a generally triangular configuration, including a pair of display faces 222 and 224. The faces 222 and 224 are adjacent each other, but separated by an angle which is preferably an obtuse angle, greater than ninety degreee. If a distance marker such as 18*a* is used, only a single distance marker may be needed, depending on the width of the practice course 1, and the size of the distance marker.

The use of the distance markers, such as 18 or 18*a*, may be used in conjunction with a variety of actuating systems. For example, microswitches, or the like, may be located at spaced apart positions on the track 12 to be actuated by the guide pins as they move in the track 12. The microswitches may in turn be connected either by a direct wire connection to the distance marker system or the microswitches may actuate a radio transmitter which transmits a signal to a receiver connected to the distance marker system. In the alternative, an inductive pickup system may be included with the track which is sensed by the movable green as it moves along the track which actuates a transmitter which in turn causes the visual display of the distance marker to increment. As a variation, an inductive system may be included with the track. The inductive system detects the passing of the movable green and a signal is appropriately transmitted to the distance marker to increment the visual display.

Another system which may be employed is a radar system, using the pin, or a flag on the pin, as the radar target and reflector, with the distance information in turn transmitted to the distance marker apparatus for decoding and printing of the visual readout. Obviously, there are several variations of such a system. There are also other systems which may be used.

FIG. 6 is a view of the apparatus of FIG. 4 taken generally along line 6—6 of FIG. 4. It comprises a top view of the lower frame 30 and the rotating frame 100 secured thereto. A portion of the rotating frame is broken away to show various components beneath the platform 102.

The transverse frame members 32, 34, 36, 38, 40, and 42 are shown extending between, and secured to, side frame members 50 and 52. For providing additional support for the axle 70, a pair of longitudinally extending braces 54 and 56 are shown extending between and secured to the front transverse frame member 32 and the intermediate transverse frame member 36. The axle 70 is appropriately secured to, and journaled for rotation on, the braces 54 and 56 and also the side frame members 50 and 52. Drive wheels 72 and 74 are in turn secured to the axle 70.

The transverse frame member 32 may include a plurality of holes 33. The holes 33 mate with holes 312 (see FIG. 13) or 412 (see FIG. 16) for securing distance marker 300, or distance marker 400, respectively, to the lower frame 30 by means of bolts, or the like.

The driving motor 80 is shown disposed on the intermediate frame member 36. Chain 84 extends from a sprocket connected to the rotating shaft of the motor 80 to the sprocket 82 secured to the axle 70. The axle 70 is a drive shaft for the drive wheels 72 and 74.

Another pair of braces 58 and 60 extend longitudinally between the rear frame member 34 and the intermediate frame member 42. The frame members 58 and 60 provide, with the side frame members 50 and 52, appropriate support for caster wheels 76 and 78 which are respectively secured to the brace 58 and frame member 50, and to the brace 60 and frame member 52. The wheels 76 and 78 caster to allow the lower frame 30 of the movable golf green apparatus 10 to move along a curved (or winding or serpentine) path in accordance with the particular configuration of the guide track 12, as illustratively shown in FIGS. 1, 2, and 4. The lower frame 30, and accordingly the apparatus 10, is guided in the track by a pair of guide pins 44 and 46, which are appropriately secured to the front and rear frame members 32 and 34, respectively.

Centrally disposed with respect to the lower frame 30 is the rotating frame 100. The rotating frame 100 includes the platform 102 which is secured to the plate 104 by four vertical braces 106, 108, 110, and 112, and by four diagonal braces (or gussets) 120, 122, 124, and 126. The vertical braces extend directly between the platform 102 and the plate 104, while the diagonal braces are shown in FIG. 4 as extending from the lower portion of the vertical braces outwardly and upwardly to the platform 102.

The plate 104 is in turn secured to the drum 114. The drum is rotatably journaled in bearings 116 (see FIG. 4) secured between the intermediate transverse frame members 38 and 40 and between the longitudinal side members 50 and 52. Thus the rotating frame 100 is centrally and symmetrically located with respect to the lower frame 30.

A sprocket 88 is secured to the drum 114 and the chain 90 extends around the sprocket 88 to couple the drive motor 86 to the rotating frame. The drive motor 86 is in turn secured to the intermediate frame member 42 adjacent the control box 130.

While the motor 80 is a reversible motor in order to allow the apparatus 10 to move "in" and "out" along the track 12, the motor 86 need not be a reversible motor. The purpose of the motor 86 is to cause the rotating frame, and the top frame (see FIG. 4) secured thereto to rotate relative to the lower frame 30, the rotation may be accomplished in one direction only, rather than in opposite directions. The net effect is the same, and the control system is simplified if the motor 86 moves in one direction only.

A pair of battery packs 132 and 134 are illustratively shown as secured to the transverse frame member 42 and the right side frame member 50 and left side frame member 52, respectively. The battery packs are shown disposed beneath the rotating frame and on opposite sides of the motor 86. The purpose in showing the battery packs 132 and 134 is illustrative only. Obviously, a source of power must be provided for the motors 80 and 86. Batteries appear to be the most logical source of power. Battery packs, or banks of batteries, may be secured to the lower frame 30 at appropriate locations. Both motors 80 and 86 may draw from a plurality of batteries hooked in series and/or parallel, or each motor may be connected to its own separate battery system.

It is believed that rechargeable batteries and electric motors powered thereby provide the most practical and economical source of power for the movement and operation of the movable golf green apparatus 10. However, it is obvious that alternate power sources may also be used. For example, a pair of conductive cables may be disposed in the track from the lower frame for connecting the electric motors to the cables. Alternately, an endless cable may be provided in the rrack and the apparatus may be clamped to the cable for movement along the track. The rotating platform 100 may in turn be geared to rotate slowly as the lower frame moves with the cable. However, as indicated above, it is believed that the provision of rechargeable batteries and two electric motors is the most practical method of powering the movable golf green apparatus 10.

FIG. 7 comprises an enlarged schematic representation of a pin 26 spaced apart from a rotating cup 21, taken generally from circle 7 of FIG. 4. In FIg. 4, the mechanism for rotating the cup is designated generally by "M." The pin 26 rotates with the cup and a sweep 28, secured to the pin, sweeps balls away from the cup.

The cup 21 is appropriately journaled for rotation in a bearing cup 170 which is appropriately secured to the green form 160, as by bolts, or the like. The cup 21 includes a socket 174 which receives a mating shank portion 176 of the pin 26. The sweep 28 is appropriately pivotally secured to the pin 26 by a hinge 29.

A motor 180 is secured to a bearing cup 170 and coupled to the socket 174 to rotate the socket and the pin and its sweep. The motor is geared to provide an appropriate rotational speed for the socket and pin. The shaft of the motor 180 is shown extending through the cup 170 and to the socket 174, to which it is secured, for rotating the socket, and the shank portion 176.

As illustrated in FIG. 2, the green 20 includes a plurality of cups 21 into which a pin may be inserted. An advantage of having more than one cup is to provide a variety of different green layouts for practice. Preferably, each cup includes its own motor and all motors are electrically connected so that no switching is required when the pin 26 is manually moved from one cup to another cup. The motors for the cups may be controlled by a timer to periodically cause the cups to rotate. In the alternative, the motors may be radio controlled, as desired.

Figure 8:
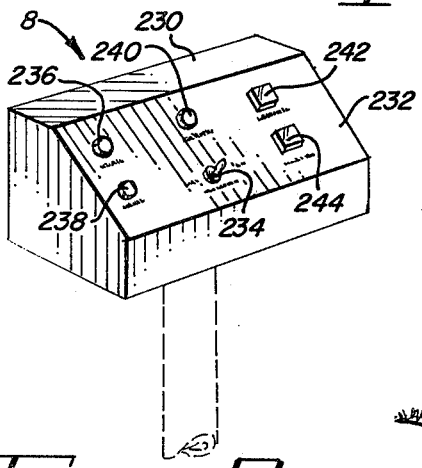
FIG. 8 is a perspective view of a control console usable with the apparatus of the present invention.

FIG. 8 is a perspective view of the control box or console 8 illustrated in FIG. 1 as being adjacent the tee stations for remote control of the movable golf course apparatus 10. The control box or console 8 is substantially the same as another console which may be located in the main building 6. However, for flexibility, it may be advantageous to provide the remote control console 8. The console 8 is disposed in a housing 230 which is preferably waterproof to protect the circuitry inside the housing from rain, and the like. The housing 230 includes a front console panel 232 on which are disposed the appropriate controls for movement of the apparatus 10. The console is shown in FIG. 8 as includingsix elements, a power switch 234, two directional control switches 236 and 238, a rotary movement switch 240, and two indicator lights 242 and 244. The on-off power switch is preferably spring loaded to the "off" position and accordingly must be held to the "on" position by a user. Similarly, the in and out push button switches 236 and 238, respectively, and the rotate switch 240, are also spring loaded to the off position. This prevents inadvertent actuation of the apparatus and prevents the unnecessary drain of electrical power from the batteries at the apparatus. Additional function switches may also be included, such as a switch for rotating the green cups to sweep the green.

Since the golf apparatus 10 includes its own power system, no direct wire connection is required to provide electrical power to the apparatus. Since no direct electrical wires are necessary, appropriate transmit-receive apparatus, such as a radio transmitter at the control box 8 or at the office 6 (see FIG. 1) and a receiver on the movable green apparatus 10, must be provided to turn on and turn off the motors 80, 86, and 180 in response to the activation of the switches at the control box 8.

The on-off or power switch 234 is spring loaded to the off position. When it is held in the on position, it provides power to the transmitter either within the control box 8 or located remotely within the main building 6 (see FIG. 1). At the same time the switch 234 is held to the on position, either the in or out switch 236 or 238, respectively, must be held on (in) to cause the motor 80 to run in either its forward or "in" direction or its reverse or "out" direction, according to which switch is actuated. Similarly, to allow the rotating frame to rotate, the switch 240 must be held to its on position while the on/off switch 234 is held in its on position to cause the motor 86 to operate to cause the rotating frame 100 to rotate to thereby rotate the top frame 150 (see FIG. 4). The switches 236, 238, and 240 are connected to an appropriate transmitter (or transmitters) to cause the transmitter(s) to send appropriate signals to a receiver (or receivers) in the control box 130 (see FIGS. 4 and 6). Appropriate control circuitry then relays the command(s) to the motor(s) to cause movement of the apparatus 10.

The indicator lights 242 and 244 may be used to show that power is on, that a command is being transmitted, or the like, as desired.

While two switches 236 and 238 are shown in FIG. 7, it is obvious that forward and reverse movement of the apparatus 10 may be accomplished by using a single pole double throw switch in place of the two separate switches.

If desired, timers may be incorporated on the apparatus 10, with each motor controlled by a preset timer. This would provide automatic movement of the apparatus at predetermined time intervals.

Figure 9:
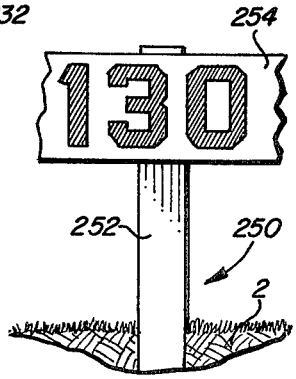
FIG. 9 is a view of an alternate embodiment of distance information apparatus usable with the present invention.

FIG. 9 is a view of an alternate embodiment of a distance marker 250 which may be used with the apparatus of the present invention. The distance marker 250 comprises a fixed marker which includes a pole 252 embedded in, and extending upwardly out of, the fairway 2 with a plate 254 permanently attached to the pole. The plate 254 is shown with three numerals on the plate, signifying that the marker is located 130 yards away from the center portion of the tee stations. The fixed distance marker 250 is the simplest and least expensive type of distance marker which may be used with the apparatus of the present invention. However, if such distance markers are located along the track, the obvious problems of the possibility of a golf ball hitting one of them is present, and the problem with distance vision of the users of the apparatus is another factor to be considered. As the markers are located farther away from the tee stations, they should get larger in order to allow them to be seen easily by the users of the apparatus at the tee stations.

Another consideration of the fixed distance markers is the problem of having them located at meaningful distances from each other. That is, if they are spaced apart every ten yards or so, there obviously must be many of the markers, which tends to clutter up the golf course.

Figure 10:
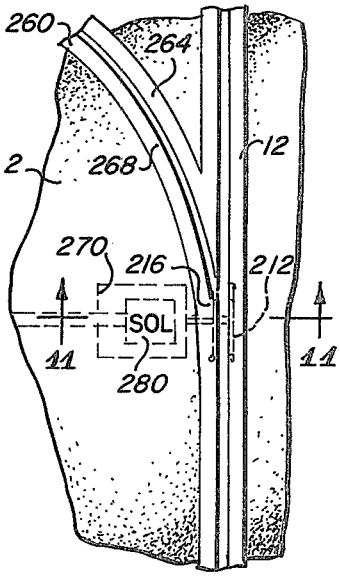
FIG. 10 is a top or plan view of a switchable track apparatus usable with the present invention.

FIG. 10 is a top view of a switchable track apparatus usable with the present invention. The track 12 is shown on the fairway 2 with a branch or spur track 260 extending away from the main track 12. The movable golf green apparatus 10 is guided along the track 12 and by means of a pair of movable plates 212 and 216, hingedly fixed to the track 12, the apparatus 10 may be switched to the track 260. The movable plates 212 and 216 are actuated by means of a solenoid 280 disposed in an enclosure 270 beneath the top surface of the tracks 12 and 260, and accordingly beneath the fairway 2.

Figure 11:
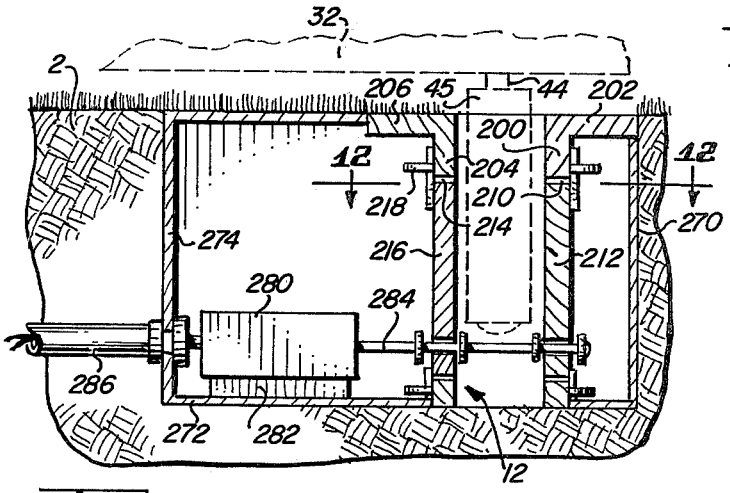
FIG. 11 is a view in partial section of a portion of the apparatus of FIG. 10 taken generally along line 11—11 of FIG. 10.

FIG. 11 is a view in partial section of the apparatus of FIG. 10 taken generally along line 11—11 of FIG. 10. It comprises a view in partial section through the enclosure 270 and illustrating the movement of the switching plates 212 and 216 by the solenoid 280.

The front guide pin 44, with its roller 45, is shown in phantom extending downwardly into the track 12 from the front member 32 of the movable green 10. The vehicle frame 32 and the guide pin are shown in phantom, extending downwardly into the track 12. The track walls 200 and 204 are interrupted by a pair of openings 210 and 214, respectively. In the openings 210 and 214 are a pair of movable plates 212 and 216, respectively. The plates 212 and 216 are appropriately hinged to the walls 200 and 204 by a plurality of hinges 218. As a practical matter, two hinges 218 may be secured to each plate, one hinge at the top of each plate and one hinge at the bottom of each plate. The hinges are appropriately secured to the track walls and to the plates.

Within the enclosure or box 270 is a solenoid 280 disposed on a floor or bottom 272 of the enclosure 270. The solenoid is disposed on the base 282 which in turn is secured to the floor or bottom 272 of the enclosure. An actuator rod 284 extends outwardly from the solenoid 280 and is appropriately secured to both the plates 212 and 216. Actuation of the solenoid 280 results in an inwardly directed movement of the rod 284 with respect to the solenoid 280, and there is an accompanying pivoting action of the plates 212 and 216 on their hinges 218 away from the track walls 200 and 204, respectively.

Electrical power to actuate the solenoid 280 is provided through appropriate electrical conductors which extend through an electrical conduit 286 secured to a wall 274 of the enclosure 270. The electrical conductors extend through the conduit to the solenoid 280. The solenoid 280 is spring loaded, as is well understood in the art, to the position shown in FIG. 10, in which the plates 212 and 216 are appropriately aligned with the track walls 200 and 204. Accordingly, the guided pin 44 guides the apparatus 10 in the track 12. However, upon actuation of the solenoid 280, the rod 284 moves to the left, as shown in FIG. 12, or inwardly with respect to the solenoid 280, to cause the plates 212 and 216 to pivot on the walls 200 and 204 to allow the guide pin 44 to guide the apparatus into the track 260.

Figure 12:
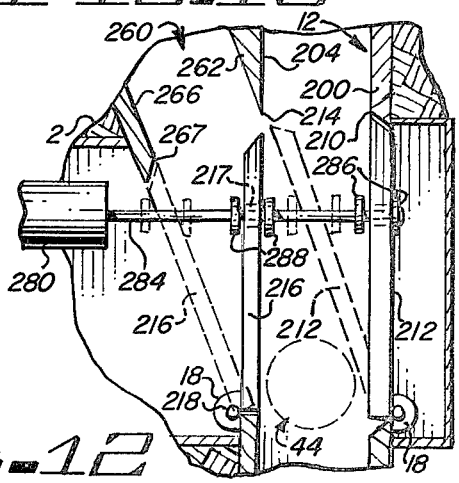
FIG. 12 is a view in partial section of a portion of the apparatus of FIG. 10 taken generally along line 12—12 of FIG. 11.

FIG. 12 is a top view of the apparatus of FIG. 11 taken generally along line 12—12 of FIG. 11. It is a view in partial section through the tracks 12 and 260 illustrating the pivoting of the guide plates 212 and 216 away from track 12 and towards track 260.

The juncture of track 260 with track 12 is shown substantially enlarged from the view in FIG. 10. The track 260 includes a pair of spaced apart walls 262 and 266. The walls 262 and 266 are both secured to the track wall 204 of the track 12. The opening 214 in the track wall 204 is at the junction of the track wall 204 with the track walls 262 and 266 of the track 260. In addition, the track wall 266 also includes an opening 267 which is adjacent the opening 214. The guide plate 216 is disposed in the opening 214, and thus parallel to the track wall 204, when the solenoid 280 is in its off condition, with the plate 216 aligned substantially parallel with the plate 212 and the track wall 200. When the solenoid 280 is actuated, the plate 216 swings in an arc on its hinges 218 to the opening 267 in the track wall 266. At the same time, the plate 212 pivots on its hinges 218 between the track walls 200 and 204 to the opening 214 at the juncture of the track walls 204 and 262. Accordingly, the guide pin 44, which extends downwardly into the track 212, contacts the plate 212 and moves, as it is guided by or between the plates 212 and 216, into the track 260 through the opening 214 and between the track walls 262 and 266.

The guide plates 212 and 216 include a pair of apertures or slots 213. The apertures of slots 213 receive portions of the solenoid actuating rod 284. The apertures or slots are substantially greater in length than the diameter of the rod 284 to allow for the rod to move in a straight line as the plates pivot. The extra length (or width) of the slots accordingly permits axial movement of the rod 284 during the pivoting movement of the ptates 212 and 216.

The rod 284 is secured to the plates 212 and 216 by a pair of washers or pins which are secured to the rod on opposite sides of each plate. A pair of washers or pins 286 is secured to the rod 284 on opposite sides of the guide plate 212, and a pair of washers or pins 288 is secured to the rod 284 on opposite sides of the guide plate 216. The length of the pins, or diameter of the washers, as the case may be, is greater than the length (or width) of the apertures or slots 213 to insure that the plates 212 and 216 pivot in response to movement of the rod in both directions, according to the state or condition of the solenoid 280. In FIG. 12, the washers or pins 286 and 288 are shown disposed slightly spaced apart on opposite sides of the plates 212 and 216. This allows the rod 284 to move in the apertures or slots 213, as required during the actuation of the solenoid 280 to its switching position, to allow the pin 44 to move from the track 12 into the track 260, and vice-versa, from the track 260 to the track 12, when the solenoid is actuated, and to cause the pin 44 to remain in the track 12 when the solenoid 280 is in its off or unactuated position, which is the position shown in FIGS. 11 and 12. In the actuated position of the solenoid 280, the plate 212 moves to the position shown in phantom in FIG. 12 to block track 12 and the plate 216 moves away from the track wall 204 to open the track 260 by moving into the opening 267 in the track wall 266.

Obviously, the solenoid 280 must be actuated in order to allow the guide pin 44 and the apparatus 10 to move both into and out of the track 260. The actuation of the solenoid 280 may be in direct response to a remote switch, such as on the console 232 of the control box 8, as shown in FIG. 8, or in the main building 6, shown in FIG. 1. It will be noted from FIG. 12 that the plate 212 is slightly longer than the plate 216. However, the actual size of the plates may be as required, according to the tracks, the diameter of the guide pin, and the spacing between track walls.

The enclosure 270 may be made of any appropriate material. Obviously, for repair and replacement of the solenoid and the plates associated with the track switching, it is preferable to have a lid or top to the enclosure that is removable.

FIG. 13 is a perspective view of an outrigger type of distance marker apparatus usable with the movable golf green 10 of the present invention. The distance marker apparatus 300 provides a continuous display of information and is accordingly not dependent upon microswitches, or any type of inductive or other sensing systems to provide distance information. However, as with the fixed distance marker apparatus illustrated in FIG. 9, a potential disadvantage with distance marker apparatus 300 is the size of the numerals, for readout purposes, to provide information which is readily visible at substantial distance from the tee stations 4 illustrated in FIG. 1.

The distance marker 300 includes a plate 310 which secures to the lower frame 30 (see FIGS. 4 and 6) of the movable golf green 10. The plate 310 is preferably rectangular in configuration, and it includes a plurality of holes or apertures 312 extending through the plate which receive appropriate bolts for securing the distance marker 300 to the lower frame 30.

Between the enclosure 302 and the plate 310 is a truss 314. The truss is secured to both the enclosure and the plate. As shown in FIG. 13, the truss comprises three sections 316, 330, and 340. Each section includes a pair of spaced apart struts, comprising rods or tubes, and a plurality of diagonal braces extending between them. For example, the truss 316 includes a pair of parallel struts 318 and 320 which are each (or both) connected to the plate 310. Three diagonal braces 322, 324, and 326 extend between the stuuts 318 and 320.

The truss 330 comprises a pair of parallel struts 332 and 334 with a pair of diagonal braces 336 and 338 extending between, and secured to, the struts 332 and 334. The truss 340 includes a pair of parallel struts 342 and 344 with three diagonal braces 346, 348, and 350 extending between the struts.

The respective struts and braces are appropriately secured together, as by welding, to comprise the separate trusses which, when secured together, cause the enclosure 302 to be spaced apart from the frame of the golf green apparatus 10. The distance marker 300 is secured directly to the lower frame, rather than to the rotating frame or the top frame. Accordingly, the enclosure 302 remains in a fixed position relative to the lower frame and also relative to the users of the apparatus regardless of the orientation of the rotating frame and of the top frame secured to the rotating frame. While the rotating frame and top frame rotate to present different targets for the golfers using the apparatus, the distance marker apparatus 300 remains in a fixed position regardless of the rotation of the rotating and top frames. However, the truss 314 is disposed low enough to the ground, or to the fairway 2, that it does not interfere with the rotation of the top frame. The caster wheels secured to the top frame roll over the truss 314 without any damage to either the caster wheels or to the rotating frame. There is, of course, sufficient flexibility in the top frame to allow for such movement. In the alternative, a U-shaped saddle bracket 352, such as shown in FIG. 13A, may be inserted in the truss at a radial distance away from the center of rotation which coincides with the radial distance of the outrigger wheels 158 (see FIG. 4) from the center of rotation.

The bracket 352 comprises a pair of parallel and spaced apart side plates 354 and 358, and a bottom plate 356 extending between and secured to the side plates. Portions of the truss may be appropriately secured, as by welding, to the side plates 354 and 358. The bottom plate 356 is disposed adjacent the fairway at a radial distance equal to the radial distance of the wheels 158 to provide a saddle on which the wheels 158 may roll to pass the truss 330.

FIG. 14 is a view in partial section of a portion of the apparatus of FIG. 13 taken generally along line 14—14 of FIG. 13. It comprises a view in partial section through the enclosure 302 of the distance marker apparatus 300.

The strut 342 is shown secured to a bracket 360, as by welding. The enclosure 302 is in turn secured to the bracket 360 by appropriate means. Within the enclosure 302 is a bottom plate 362. A yoke 364 is in turn secured to the plate 362 by appropriate means, such as a bolt 366. The yoke 364 is then secured to, and supports, a wheel 370. The wheel is secured to and supported on the yoke 364 by axle 372. The revolutions of the wheel 370 and its axle 372 are counted by a counter 380. The counter 380 is linked to the axle 372 and the wheel 370 by a rotating element 382 which bears directly against the axle 372. A cable connection 384 extends between the counter 380 and a display control 386. The cable connection 384 may be either an electrical cable or a direct drive cable connection, as desired. The display control 386 in turn is connected to a display panel 388 adjacent the face 304 of the enclosure 304. The display panel 388, which, as indicated, may be a plurality of electric lights, displays the distance information so that the users of the golf course apparatus at the tee stations may be apprised of the distance from the tee stations that the movable golf green apparatus is located at any specific time.

The display control 386 is set for a specific, predetermined amount corresponding to the distance from the tee stations 4 (see FIG. 1) to the front or "in" track end 14, and the distance information is then calibrated from the front or "in" track end 14 to the back or "out" track end 16, all as indicated in FIG. 1. Auxiliary information may be given at each of the tee stations pertaining to the yardage to be added to that displayed on the panel 388 with respect to the location of the different tee stations away from the central tee stations.

FIG. 15 is a view in partial section of a portion of the truss 314 taken generally from circle 15 of FIG. 13. It comprises a view in partial section through the juncture of truss sections 330 and 340.

The strut 334 of truss 330 comprises a tubular member with a pin 335 secured to the bore of the strut, as by welding. The pin 335 extends outwardly from the tubular strut 334.

The strut 344 of the truss section 340 comprises also a tubular member, substantially identical to the strut 334. The pin 335 extends into the bore of the strut 344. A bolt 341 secures together the struts 334 and 344 by extending through aligned holes or apertures in the strut 344 and the pin 335. The apertures are preferably diametrically extending through the strut and the pin. A nut 343 threadedly engages the shank of the bolt 341, and a lock washer preferably is secured about the shank of the bolt between the nut and the strut 344.

The securing together of the two truss sections 334 and 344 illustrated in FIG. 15 is representative of the securing together of each strut of the three truss sections.

FIG. 16 is a perspective view of an alternate embodiment of the apparatus of FIG. 13, comprising a single tubular boom or support for a display enclosure. A continuous display distance marker 400 is shown for a display enclosure 402. The enclosure 402 includes a display face 404 on which is displayed distance information. The distance information is in turn coupled with the wheel 406, in a manner similar to that illustrated above and discussed in conjunction with FIG. 14.

The continuing distance display 400 comprises a singular boom 418 rather than the truss 314 as illustrated in FIG. 13, above. The boom 418 is secured to a bracket comprising a pair of plates 410 and 414. The plate 410 includes the plurality of holes 412 for securing the plate 410 to the lower frame of the movable green apparatus 10, discussed above. The plate 414 is illustrated as being disposed substantially perpendicular to the plate 410. The boom 418 is in turn secured to the plate 414. The boom 418 includes three tubular sections, including a first tubular section 420, an intermediate tubular section 424, and a distal tubular section 428. The tubular section 420 is appropriately secured to the plate 414, as by welding. The tubular sections 420 and 424 are secured together as by an appropriate bolt 422 extending through a coaxial portion of both tubular sections. Similarly, a bolt 426 extends through a coaxial portion of the tubular sections 424 and 428 to secure them together.

The distal tubular section 428 is appropriately secured to the enclosure 402. A pair of braces, including a brace 430 and a brace 432, extend outwardly from the tubular section 428 to the enclosure 402 to help secure the enclosure to the tubular section and accordingly to the boom 418.

A bracket, such as bracket 352, shown in FIG. 13A, may be interposed, as between sections in the boom 418 to allow the stabilizing outrigger wheels 158 to pass through, or over, the boom in the simplest manner, as described above in conjunction with the embodiment of FIG. 13.

Appropriate display information is displayed on the face 404 of the enclosure 402. The distance information is secured, ultimately, from a wheel 406. The enclosure 402 may be substantially identical to the enclosure 402 illustrated above in conjunction with FIGS. 12 and 13. The distance information presentation from wheel 402 may be substantially identical as illustrated in conjunction with FIG. 13 and the wheel 370.

An alternative to the display information illustrated in FIG. 13 and discussed in conjunction with FIGS. 13 and 14, may be a digital display formed from a plurality of segmented panels, such as is commonly used for digital display clocks in contemporary usage, with other than electronic (L.E.D.) readouts. Such segmented panels are illustrated more clearly in conjunction with FIG. 17.

The single boom 418 of FIG. 16 may be used as opposed to the truss arrangement of FIG. 13. Obviously, the single boom may be less expensive and lighter than a truss, but, also obviously, is not as strong. Accordingly, various factors may be considered in selecting the most advantageous type of continuous distance information display apparatus. The bracket 352 of FIG. 13A may be used for either type. For a truss, either a relatively long bracket, such as indicated in phantom in FIG. 13A, or two shorter brackets may be used with the truss. For example, if two brackets were used, one bracket could be secured to each strut at the junction of two adjacent truss sections.

FIG. 17 is a perspective view of the alternate display of enclosure 450 usable with the apparatus of FIGS. 13 and 16 in place of the enclosures 302 and 402, respectively illustrated therewith. The enclosure 450 is shown illustratively secured to the tubular section 428 of FIG. 16.

Beneath the enclosure 450 may be seen a portion of a wheel 452, the revolutions of which are counted and translated into distance measurements, as discussed above in conjunction with FIG. 14.

The distance information originating with the wheel 452 is displayed by a pair of display panels or faces 454 and 456. The faces are disposed at the obtuse angle with respect to each other so as to provide distance information over a broader area than is convenient or possible with only a single display face, such as shown in FIGS. 13, 14, and 16. The display panels 454 and 456 are divided each into six segments or portions, with three segments at the lower half of each display panel and three segments at the upper half of each display panel. The segments are substantially identical in size and each segment comprises one half of a digital display numeral. A top and bottom segment cooperate to provide a single numeral. The numerals are controlled separately from each other to provide distance information in increments of one yard. The digitial readout is a well-known, state of the art readout system employed widely for digital clocks, and the like. The only substantial difference between the digital readout embodied in the enclosure 450 of FIG. 17 and that of digital clocks is in size and in the control of the readout, not by a motor, as in digital clocks, but rather by the incrementing of distance through the revolutions of the wheel 452. Moreover, the digital readout of the enclosure 450 in FIG. 17 is continuous in both directions of travel.

As illustrated herein, the movable golf green apparatus moves along a fixed, predetermined path, defined by a slotted track. The slotted track, with an alternate spur track, provides a maximum amount of flexibility of use for a relatively minimum cost. The apparatus requires only two motors, one of rotating the green and one for moving the apparatus along the track. (The smaller motors for sweeping the green are, of course, extra, but they are relatively small.) The electrical circuitry involved in such an arrangement is also minimal, requiring only transmitting and receiving apparatus if movement of both the frame and the green are to be moved on direct command, or, in the alternative, pre-programmed circuitry to actuate the two motors not upon command but in accordance with a predetermined time schedule, or the like.

However, it is obvious that other types of guidance systems may be used, for example buried cable and inductive sensing for directional control, a programmable steering system, or remote directional control for command or real time steering. With respect to the first alternative, a buried cable and inductive sensing, additional circuitry is necessary for such system. Moreover, the same is true with a programmable steering system where a predetermined or preselective course may be programmed into the driving and steering system of the apparatus. Similarly, a remote directional control system requires substantial changes and additions in the electrical circuitry involved. Moreover, all three alternative systems as discussed in this paragraph also require a movable steering wheel system, which is not required with the track and guidance pin system disclosed herein.

The apparatus disclosed herein comprises a relatively inexpensive system for providing a maximum flexibility for a driving range, and which simulates a wide variety of circumstances found on a golf course. The apparatus allows users of a driving range to practice a wide variety of shots, and all of this type activity is accomplished in a relatively minimum amount of space and with a minimum investment.

Figure 18:
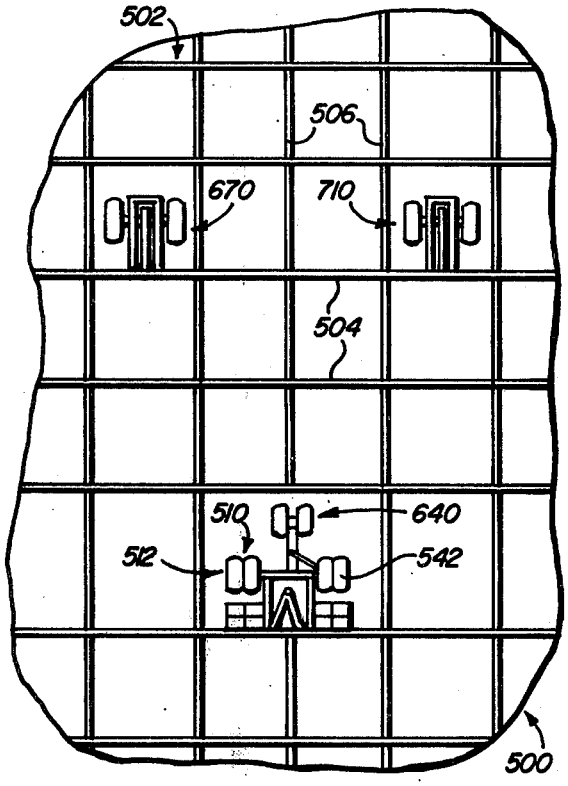
FIG. 18 is a top view of an alternate embodiment of a frame and wheel system of the apparatus of the present invention.

FIG. 18 is a top view of an alternative embodiment 500 of the movable green apparatus discussed above in conjunction with FIGS. 1–17. The movable green apparatus 500 comprises a unitary frame 502 which may directly receive the green form 160, shown best in FIG. 4.

The frame 502 includes a plurality of transverse frame members 504 and a plurality of longitudinal frame members 506. The frame members 504 and 506 are shown spaced apart in a regular orientation in FIG. 18. However, as is obvious, the frame members, which are appropriately secured together, include vertical frame members which are not shown in FIG. 18.

The frame 502 is preferably of a bulkhead type which includes vertical frame members of varying heights secured to the longitudinal, transverse, and diagonal frame members which in turn support a variably contoured green form, not unlike the green form 160, as discussed above. That is, the various bulkheads which comprise a unitary frame include a plurality of longitudinal, transverse, and vertical frame members which are appropriately dimensioned to receive a green form having a variable contour or topography to realistically simulate a golf green and the area adjacent a golf green. In FIG. 18, which is a top view, only the basic longitudinal transverse frame members are shown. However, the details of such bulkhead type frames are well known and understood.

The unitary frame embodiment 500 is propelled by a drive wheel assembly 510 which is appropriately secured to the frame 502. The drive wheel assembly 510 includes a pair of dual drive wheel units 512 and 542. Secured to the drive wheel assembly 510 is a steering wheel assembly 640. Rearwardly of the drive wheels, and secured directly to the frame 502, are a pair of support wheel assemblies 670 and 710. The support wheel assemblies are appropriately spaced apart from each other and from the drive wheel assembly for optimum balance, support, etc. The drive wheel assembly 510 will be described in detail in conjunction with FIGS. 19, 20, 21, 22, and 23. The steering wheel assembly 640 will be discussed in detail in conjunction with FIGS. 19 and 20. The support wheel assemblies 670 and 710 will be discussed in detail in conjunction with FIGS. 24 and 25.

Referring now to FIGS. 19, 20, 21, 22, 23, it will be noted that the drive wheel assembly 510 comprises two pair of dual drive wheel units 512 and 542. As best shown in FIG. 22, which is a perspective view of the drive wheel assembly 510, the dual drive wheel unit 512 includes a pair of drive wheels 514 and 516 secured to a common axle 518. The axle 518 is in turn secured to a frame 580. The dual drive wheel unit 542 includes a pair of wheels 544 and 546 secured to a common axle 548. The axle 548 is also secured to the frame 580. See FIG. 21.

A pulley or sprocket, shown best in FIG. 22, is appropriately secured to the axle 518 to which the wheels 514 and 516 are secured. The pulley or sprocket 520 is in turn coupled to another pulley or sprocket 524 by a belt or chain. The pulley or sprocket 524 is in turn secured on a common shaft to another pulley or sprocket 526. The pulley or sprocket 526, and the pulley or sprocket 524 is also substantially less in diameter than the pulley or sprocket on axle 518. The pulleys or sprockets 524 and 526 are, as stated, appropriately secured together on a common shaft which is in turn journaled for rotation on the frame 580, as will be discussed below.

The pulley or sprocket 526 is coupled to a relatively small sprocket or pulley 530 through a belt or chain 528. The pulley or sprocket 530 is secured to a relatively large pulley or sprocket 532, which is in turn coupled to a relatively small pulley or sprocket 536 by a belt or chain 534. The pulleys or sprockets 530 and 532 are secured together to a common shaft which is also journaled for rotation on the frame 580. The pulley or sprocket 536 is secured to the output shaft of a motor 538. The motor 538 comprises the drive motor for the dual drive wheel unit 512.

In conjunction with the dual drive wheel units 512 and 542, it will be noted that they may be driven either by a chain drive or by a belt drive. If a belt drive is used, then pulleys will, of course, be used. If a chain drive is used, then sprockets will be used. Furthermore, it is obvious that various ratios between the several sprockets or pulleys coupled together by the belts or chains may be used to accomplish appropriate gearing, as desired, between the drive motors and the drive wheels.

Figure 21:
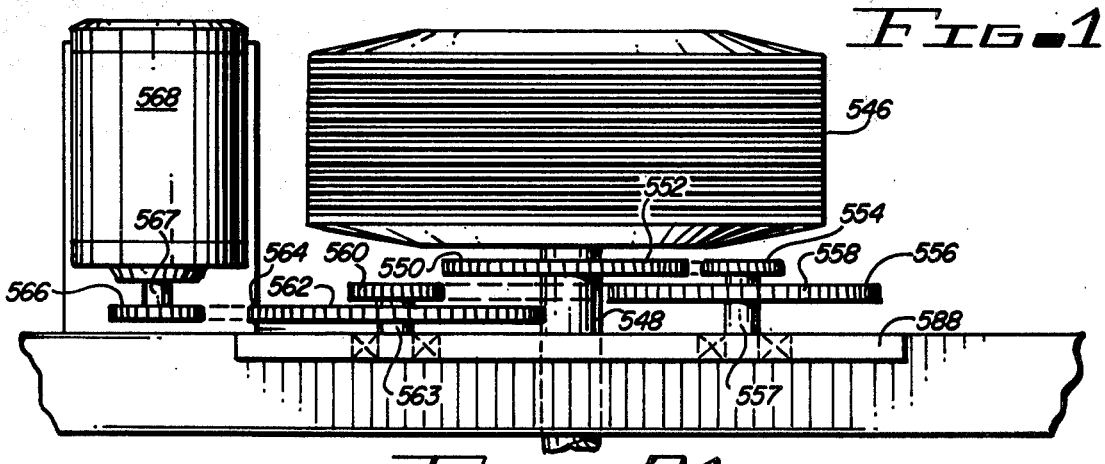
FIG. 21 is an enlarged view of a portion of the apparatus of FIG. 19 taken generally along line 21—21 of FIG. 19.

The dual drive wheel unit 542 includes a pair of drive wheels 544 and 546 coupled together on a common axle or shaft 548, as best shown in FIG. 21. The shaft or axle 548 is appropriately secured to and journaled for rotation on the frame 580. A pulley or sprocket 550 is secured to the axle 548 and the pulley or sprocket 550 is coupled to a smaller pulley or sprocket 554 through a belt or chain 552. The relatively small diameter pulley or sprocket 554 is secured to a common shaft 557 with a relatively larger diameter pulley or sprocket 556. The shaft 557, to which both the pulleys or sprockets 554 and 556 are secured, is in turn appropriately journaled for rotation on a plate 588 secured to the frame 580.

The pulley or sprockt 556 is coupled to a relatively smaller diameter pulley or sprocket 560 through a belt or chain 558. The relatively small diameter pulley or sprocket 560 is in turn secured to a common shaft 563 with a relatively large diameter pulley or sprocket 562. The shaft 563 is, like the shaft 557 and the shaft or axle 548, appropriately journaled for rotation on the plate 588 secured to the frame 580.

The relatively large diameter pulley or sprocket 562 is in turn coupled to a relatively smaller diameter pulley or sprocket 566 by a belt or chain 564. The pulley or sprocket 566 is in turn secured to an output shaft 567 of a drive motor 568.

Depending on the particular steering system employed, the drive motors 538 and 568 need not be coupled together by a single control. In the manner shown, each drive motor powers a pair of dual wheels which in turn move the golf green unitary frame embodiment 500.

The drive wheel assembly 510 includes the frame 580, to which the drive wheels and drive motors are secured. The frame 580 is a generally "U" shaped member which includes a base cross piece 582. A pair of arms 584 and 590, secured to the cross piece 582, extend forwardly from the cross piece 582. Appropriately secured to the arm 584, as by welding, is the plate 588. The shafts 557 and 563 for the pulley or sprocket system for the dual drive wheel unit 542 are, as best shown in FIG. 21, appropriately secured to the plate 588. Another plate 594 is appropriately secured to the arm 590 and the shafts for the pulley or sprocket system for driving the dual drive wheel unit 512 are appropriately journaled for rotation on the plate 594.

At the ends of the arms 584 and 590, remote from the cross piece 582, are a pair of upwardly extending diagonal arm portions 586 and 592, respectively. The upwardly extending height of the diagonal arm portions is generally the same as the overall height of the plates 588 and 594. Compensation for the height of the plates 588 and 594 is accordingly accomplished.

The diameter of the drive wheels may be as desired, with the axles of the drive wheels secured to the frame arms, and the respective drive motors are also secured to the frame arms. Appropriate speed reduction between the drive motors and the wheels is accomplished by means of the pulley or sprocket arrangements as described above, which are secured to plates, which are in turn secured to the frame arms. A relatively compact drive system accordingly results, with all of the various components easily accessible for repair, replacement, etc.

As best shown in FIG. 22, a pair of battery holders or battery plates 600 and 604 are secured respectively to the frame arms 584 and 590. The battery plate or holder 600 includes a plurality of batteries 602 which provide the electrical energy required for driving the motor 568. A plurality of batteries 606 is disposed on, and appropriately secured to, the battery plate or holder 604 for supplying electrical energy for powering the drive motor 538. The batteries 602 and 606 may be of the relatively common battery type typically used to power golf carts. As again best shown in FIG. 22, all components of the drive wheel assembly 510, including the frame, the wheels, the motors, the pulleys or sprockets with their belts or chains, and the batteries, are easily accessible for repair or replacement.

The drive wheel assembly 510 is coupled to the frame 502 through an A-frame yoke 610. The A-frame yoke 610 includes a pair of arms 612 and 614, which arms are generally diverging from an apex and which arms terminate in a generally parallel portion remote from the apex. A cross brace 616 extends between and is secured to the arms 612 and 614. At the apex of the A-frame yoke is a plate 618, which is appropriately secured to the arms 612 and 614. A ball hitch 620 is in turn secured to the plate 618. As shown in FIG. 23, which comprises a view in partial section of the apparatus of FIG. 22, taken generally along line 23—23 of FIG. 22, the ball 620 is received in an appropriate socket 503 on the frame 502 (see FIG. 23) and comprises the single connecting point between the drive wheel assembly 510 and the frame 502.

The frame arm 612 is rotatably secured to the diagonal arm portion 586 by means of a pin 622 and a bearing block 624. The bearing block 624 is secured to the arm 586, and the pin 622 is secured to the arm 612. A similar pin and bearing block arrangement is used to secure the arm 614 to the diagonal arm portion 592. A pin 626, secured to the arm 614, is rotatably journaled through a bearing block 628 secured to the diagonal arm portion 592. The pins 622 and 626 comprise the pivot points and also the securing points for the A-frame yoke 610 with respect to the frame 580.

In the golf green apparatus illustrated best in FIGS. 2, 4, and 6, the frame apparatus is vertically fixed with respect to the ground or fairway 2 on which the movable green apparatus moves. However, in the embodiment of the unitary green apparatus 500 of FIGS. 18–25, the frame 502, with a green form, such as green form 160 secured thereto, may be raised on its wheels for moving and then may be lowered for substantially direct contact with the ground or fairway on which the apparatus is disposed for use. The vertical movement of the frame 502 is accomplished relative to the wheel systems by connecting the various wheel assemblies for pivoting relative to the frame 502. For example, as has been discussed in conjunction with FIGS. 22 and 23, the drive wheel assembly 510 is secured to the frame 502 through a ball and socket connection in which a ball 620, secured to the drive wheel assembly 510 is received in the socket 503 in a frame 502. The ball 620 is secured to the A-frame yoke 610 which is in turn pivotally connected to the wheel frame 580.

As best seen in FIG. 22, the A-frame yoke 610 pivots on the arm 580 by virtue of a hydraulic cylinder 630 which is secured to the cross piece 582 of the frame 580, and a piston rod 632 which is secured to the cross brace 616 of the A-frame yoke 510. The hydraulic cylinder 630 is appropriately secured to the cross piece 582, and journaled for pivoting relative to the cross brace, while the piston rod 632 is appropriately pivotally or rotatably secured to the cross brace 616. As the piston rod 632 moves relative to its cylinder 630, under the force of hydraulic fluid within the cylinder 630, which is preferably a dual acting hydraulic cylinder and piston unit, the A-frame yoke 610 pivots relative to the frame 580. The pivoting action of the yoke 610 relative to the frame 580 causes the cylinder 630 and its piston rod 632 to pivot or rotate relative to the yoke and the frame.

Figure 19:
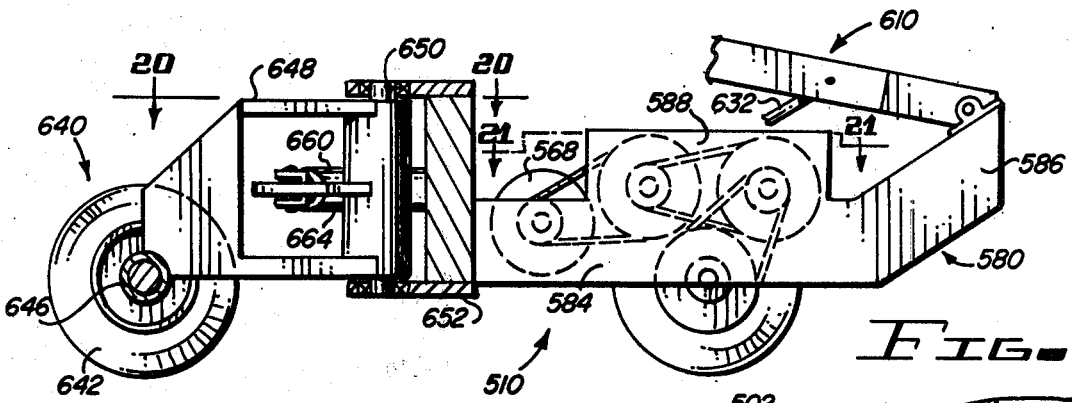
FIG. 19 is a view in partial section of a portion of the apparatus of FIG. 18.
Figure 20:
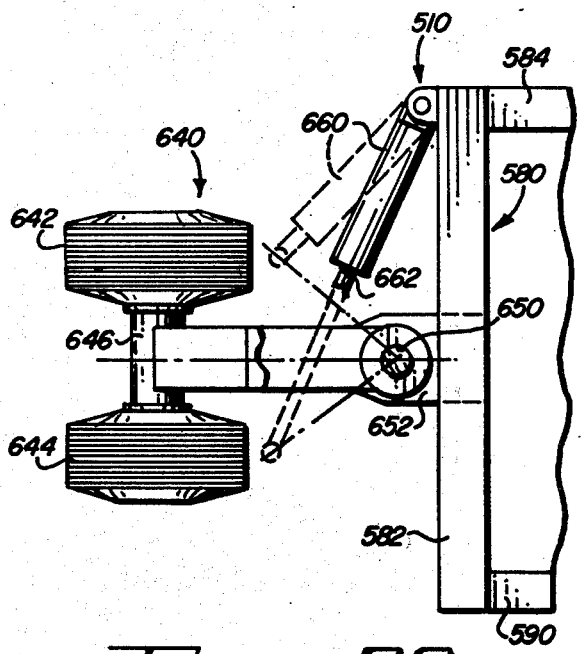
FIG. 20 is an enlarged view of a portion of the apparatus of FIG. 19, taken generally along line 20—20 of FIG. 19.

The inward motion of the piston rod 632 relative to the cylinder 630 causes the yoke 610 to pivot downwardly with respect to the frame 580, substantially to the position shown in FIG. 19 and also in FIG. 23. When the hydraulic pressure is applied to the opposite side of the piston within the cylinder 630 to which the piston rod 632 is secured, the outward movement of the piston rod 632 causes the A-frame yoke 610 to pivot upwardly relative to the frame 580, as shown in phantom in FIG. 23. The movement of the A-frame yoke 610 results in a similar movement of the frame 502, and of a green form secured to the frame 502. The frame 502 and its green form accordingly is raised to allow the apparatus to move, as desired. When the movable green apparatus 500 is in its new, desired position, hydraulic pressure is then applied to the appropriate side of the piston within the cylinder 632 to move the piston rod 632 inwardly with respect to the cylinder 630 which causes the A-frame yoke 610 to move downwardly with respect to the frame 580. The frame 502, with its green form, accordingly moves downwardly relative to the frame 580, the wheels and the ground or fairway 2. The frame is thus lowered for use.

While in the above paragraphs the cylinder 630 has been discussed as a double acting cylinder, it is obvious that a single acting cylinder may be used, in which one side of the piston secured to the piston rod within the cylinder is pressurized to move the piston outwardly to in turn raise the A-frame yoke 610 and the frame secured thereto. The hydraulic pressure is then released from within the cylinder, in a controlled manner, to allow the yoke 610 to move downwardly, with the frame secured thereto, to thus move the piston rod 632 inwardly with respect to the cylinder 630 as a result of the weight or mass of the frame 502. Appropriate hydraulic systems are, of course, well known in the art. Similarly, while the example of hydraulic actuation has been discussed, it is obvious that the A-frame yoke may be moved relative to the frame 580 by an electric motor and screw arrangement, or the like.

For steering purposes, the drive motors 538 and 568 may be controlled separately so as to move separately either at the same speed, at different speeds, or one motor may not run while the other motor does run, or any appropriate combination for steering, as desired. Indeed, the use of separate motors provides flexibility in movement of the apparatus and also in steering the apparatus. Thus, the entire movable green apparatus 500 comprises a unitary structure with appropriate radio controlled steering, or the like, as discussed above. There are various appropriate, well known methods for actuating and steering the apparatus through a pair of dual drive motors, as is well known and understood. However, if desired, a separate steering wheel assembly 640 may be incorporated with the drive wheel assembly 510. Such steering wheel assembly is shown best in FIGS. 19 and 20.

The steering wheel assembly includes a pair of wheels 642 and 644 which are secured together to a common axle 646. The axle 646 is in turn secured to a yoke 648 which is rotatably journaled on a pin 650 secured to a bracket 652. The bracket 652 is in turn secured to the cross piece 582 of the frame 580.

A hydraulic cylinder 660 is shown secured to the cross member 582 of the frame 580 by an appropriate pivotal connection. The cylinder 660 includes a piston rod 662 which extends outwardly from the cylinder 660, and which is connected to a piston movable within the cylinder 660. The piston rod 662 is in turn connected by a pivotal connection to an arm or plate 664, as best shown in FIG. 19.

The hydraulic cylinder apparatus 660 is preferably a dual acting cylinder, with a neutral position of the piston rod 662 relative to the cylinder 660 defining the longitudinally straight orientation of the steering wheel assembly 640 relative to the frame 502. This position is shown in FIG. 18 and also in FIG. 20.

Pressurizing one side or the other side of the piston within the cylinder 660 causes an inward or outward movement of the piston rod 662. The movement of the piston rod 662 in turn results in movement of the arm 664 relative to the frame 580. This relative movement in turn causes the yoke 648 to move by a pivoting motion relative to the frame 580, thus turning the steering wheel assembly 640. The turning movement of the steering wheel assembly 640 causes the entire green apparatus 500 to turn. As stated above, the steering wheel assembly 640 is optional. If the steering wheel assembly 640 is used, then the drive motors 538 and 568 may be operated in parallel, and thus obviate the need for a differential motor control system for steering. However, if a more sophisticated steering system is used to control separately the drive motors 538 and 568, then the requirement of a steering wheel assembly, with its attendant hydraulic control and actuation system, is not required.

Rearwardly of the drive wheel assembly 510, and appropriately secured to the frame 502, are a pair of support wheel assemblies 670 and 710. See FIG. 18. Each support wheel assembly includes a pair of support wheel units secured to a common axle and connected to a wheel frame and movable or pivotable vertically relative to the wheel frame. The frames for the support wheel assemblies are in turn secured to the frame 502. The wheels, as they pivot relative to the frame, cause the frame to move vertically. With the frame moved vertically upwardly relative to the support wheels, in conjunction with substantially parallel movement of the A-frame yoke 610 of the drive wheel assembly 510, the frame 502 is raised for movement. Vertically downwardly movement of the frame 502 relative to both the drive wheel assembly and the support wheel assemblies causes the frame 502, with its green form, to move downwardly relative to the ground 2 (see FIG. 23) for use.

FIG. 24 is a perspective view of the support wheel assembly 670. FIG. 25 is a view in partial section of the support wheel assembly 670 of FIG. 24 taken generally along line 25—25 of FIG. 24, and illustrating the relative vertical movement of the various elements of the support wheel assembly. The support wheel assembly 670, shown in FIGS. 24 and 25, is substantially identical to the support wheel assembly 710, shown in FIG. 18, and since they are substantially identical, only support wheel assembly 670 will be discussed in detail.

The support wheel assembly 670 includes a wheel unit 671 and a wheel frame 684. The wheel unit includes a pair of wheels 672 and 674 secured together on an axle 676. A bar 678 is also secured to the axle 676 and extends from the axle 676 to an upwardly extending bar portion 680, to which it is secured. The bar 680 extends generally upwardly and forwardly, with respect to the bar 678. The term "forwardly" in this context, as illustrated in FIG. 24, denotes a direction away from the wheels 672 and 674 and their axle 676. A strengthening fillet 681 is shown at the juncture of the bar 678 and the bar 680. A pin 682 extends through a bearing boss at the lower portion of the bar 680, adjacent the juncture of the bar 678 and the bar 680. The pin 682 is substantially parallel to the axle 676, and the bar assembly, comprising the bar 678 and the bar 680, is journaled for rotation on the pin 682. The pin 682 comprises a pivot point between the wheel unit 671, including the wheels 672, 674, their axle 676, with the associated bar structure, and the wheel frame 684, which is secured to the frame 502 of the movable green 500.

The wheel frame 684 includes a pair of vertical frame arms 686 and 690. The pin 682 is supported for rotation on the vertical frame arms 686 and 690 at their lower ends, or remote from a pair of horizontal frame arms 688 and 692. The horizontal frame arm 688 extends rearwardly from the upper portion of the vertical frame arm 686, to which it is secured. Similarly, the horizontal frame arm 692 extends rearwardly from the upper end of the vertical frame arm 690 to which it is secured. The respective vertical and horizontal frame arms are parallel to each other and spaced apart. By "rearwardly" is meant that the horizontal frame arms 688 and 692 extend from the vertical frame arms toward the wheels 672 and 674. In other words, the term "rearwardly" indicates the opposite direction from the term "forwardly" as defined above.

A transverse frame member 694 extends between the ends of the horizontal frame arms 688 and 692 remote from the vertical frame arms 686 and 690. The wheel frame 684 is appropriately secured to the frame 502, as indicated above, and accordingly remains fixed in place as the wheels pivot, as shown in FIG. 25, to raise and lower the frame 502 in conjunction with the pivoting of the drive wheel assembly 510 as described above.

The pivoting of the wheels relative to the wheel frame is accomplished by a hydraulic cylinder 696 which is pivotally secured between a pair of plates 700 and 702 which in turn is secured to the wheel frame 684. The hydraulic cylinder 696 includes therein a piston secured to a piston rod 698 which extends outwardly from the cylinder 696 and is pivotally secured to the upper portion of the bar 680, remote from the pin 682. Hydraulic pressure within the piston 696 acts against the movable piston to move the rod 698 forwardly and rearwardly, as the terms have been defined above.

The movement of the wheels relative to the wheel frame is illustrated in FIG. 25. When the movable golf green apparatus 500 is in position for use, the frame 502 is in its "down" position, which means that the wheels 672 and 674 are nested within the wheel frame 684, as shown in solid line in FIG. 25. With the frame in the "up" position, the piston rod 698 is extended to its fullest extent. When it is desired that the frame 502 be raised for movement, hydraulic pressure is applied within the cylinder 696 to move the piston, with its piston rod 698 attached thereto, inwardly with respect to the cylinder 696. The inward movement of the piston and piston rod causes the wheel assembly 671 to pivot on the pin 682 relative to the wheel frame 684. With the bar 680 moving toward the wheel frame 684, the bar 678, with the wheels 672 and 674, pivots away from the wheel frame 684. The relative movement between the wheel unit 671 and the wheel frame 684 results in the raising of the frame 502 which is secured to the wheel frame 684. With the frame in the "up" position, the movable golf green is ready for movement.

The support wheel aseembly 670 and the support wheel assembly 710 work in unison, and work also in unison with the drive wheel assembly 510, as discussed above, so that the frame moves upwardly and downwardly in a coordinated movement. The necessary controls for moving the various wheel assemblies is well known and understood. And, as has been discussed above, the vertical movement of the wheel assemblies relative to the frame, while discussed in terms of hydraulic actuation, may also be actuated electrically, as desired.

As has also been discussed in detail above, the guidance system for the unitary frame embodiment 500 may be predetermined to follow a fixed course, with appropriate rotation of the green also predetermined. Or, such movement, including the rotation or turning movement of the green as well as movement from location to location, may be made upon specific command, as by radio control. The apparatus 500 may follow a buried wire, as discussed above, by inductively sensing the wire, or any other appropriate control method may be used.

What is claimed is:

1. Movable golf green apparatus for presenting to a user a variety of orientations of a golf green over a variety of distances, comprising, in combination:

green form means, including a putting green portion having at least a single cup for receiving a golf ball, and an apron portion disposed about the putting green portion and extending outwardly and downwardly from the putting green portion:

frame means secured to the green form means and including a plurality of structural members for supporting the green form means;

wheel means secured to the frame means for moving the frame means and the green form means in a plurality of orientations relative to a user, including drive wheel means rotatable for moving the frame means and the green form means;

motor means connected to the frame means and to the wheel means for moving the frame means and the green form means; and control means for selectively actuating the motor means for moving the frame means and the green form means and for orienting the frame means and the green form means relative to a user to present a variety of orientations of the green form means over a variety of distances.

2. The apparatus of claim 1 in which the green form means includes a plurality of cups for receiving golf balls.

3. The apparatus of claim 1 in which the green form means includes a variable contour for providing a variable appearance to a user as the green form means rotates relative to the user.

4. The apparatus of claim 3 in which the green form means further includes a trap.

5. The apparatus of claim 1 in which the control means includes a track for guiding the frame means.

6. The apparatus of claim 5 in which the frame means includes guide pins secured to the frame means and extending into the track for guiding the frame means.

7. The apparatus of claim 1 in which the frame means includes a lower frame, and the drive wheel means, the motor means, and the guide pins are secured to the lower frame; and a rotating frame secured to the lower frame, and the green form means is secured to and rotatable therewith.

8. The apparatus of claim 1 in which the motor means includes first motor means connected to the drive wheels of the wheel means for moving the frame means.

9. The apparatus of claim 8 in which the motor means further includes second motor means for moving the rotating frame relative to the lower frame.

10. The apparatus of claim 1 in which the drive wheel means includes first drive wheel means and second drive wheel means spaced apart from each other for moving the frame means and the green form means.

11. The apparatus of claim 10 in which the motor means connected to the frame means and the green form means comprise a first drive motor connected to the first drive wheel means and a second drive motor connected to the second drive wheel means.

12. The apparatus of claim 11 in which the control means for selectively actuating the motor means includes means for actuating the first drive motor and the second drive motor independently of each other for rotating the apparatus.

13. The apparatus of claim 1 in which the wheel means secured to the frame means further includes steering wheel means movable for steering the apparatus.

14. The apparatus of claim 1 in which the wheel means further includes support wheel means spaced apart from the drive wheel means.

15. The apparatus of claim 14 in which the wheel means includes means for pivoting the wheel means relative to the frame means for raising the frame means and the green form means for movement and for lowering the frame means and the green form means for use after movement.

16. Movable golf green apparatus for providing a variety of distances and orientations of a golf green to a user, comprising, in combination:

golf green means;

wheel means secured to the golf green means;

motor means for moving the wheel means and the golf green means; and control means for actuating the motor means to move the wheel means and the golf green means over a variety of distances and for rotating the golf green means for providing a variety of orientations of the golf green apparatus to a user.

17. The apparatus of claim 16 in which the golf green means includes a putting green portion and an apron portion disposed about the putting green portion.

18. The apparatus of claim 17 in which the golf green means includes a first frame means and a second frame means, and the putting green portion is secured to the first frame means, and the wheel means is secured to the second frame means.

19. The apparatus of claim 18 in which the first frame means is secured to the second frame means and movable relative thereto.

20. The apparatus of claim 19 in which the motor means includes a motor connected to the first frame means for moving the first frame means relative to the second frame means for orienting the putting green portion of the golf green means.

21. The apparatus of claim 16 in which the motor means includes a drive motor for driving the wheel means for moving the golf green means over a variety of distances.

22. The apparatus of claim 21 in which the wheel means includes at least a single wheel movable for changing the direction of movement of the golf green means.

23. The apparatus of claim 22 in which the wheel movable for changing the direction of movement of the golf green means includes a casterable wheel.

24. The apparatus of claim 22 in which the wheel movable for changing the direction of movement of the golf green means includes a steerable wheel.

25. The apparatus of claim 21 in which the wheel means includes first drive means and second drive wheel means for moving the golf green means; and the motor means includes a first drive motor connected to the first drive wheel means and a second drive motor connected to the second drive wheel means; and the control means includes means for selectively actuating the first and second drive motors for moving the golf green means over a variety of distances and for rotating the golf green means to provide a variety of orientations of the golf green means.

* * * * *